US007438401B2

(12) United States Patent
Seino et al.

(10) Patent No.: US 7,438,401 B2
(45) Date of Patent: Oct. 21, 2008

(54) INKJET RECORDING APPARATUS AND INK CARTRIDGE

(75) Inventors: Takeo Seino, Nagano (JP); Hitotoshi Kimura, Nagano (JP); Kazumasa Harada, Nagano (JP); Kazuhiro Hashii, Nagano (JP); Atsuhiko Takeuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 64 days.

(21) Appl. No.: 11/026,109

(22) Filed: Dec. 30, 2004

(65) Prior Publication Data

US 2005/0248637 A1 Nov. 10, 2005

Related U.S. Application Data

(63) Continuation-in-part of application No. 10/462,942, filed on Jun. 17, 2003, now Pat. No. 7,018,027, and a continuation-in-part of application No. 10/882,528, filed on Jun. 30, 2004, now abandoned.

(30) Foreign Application Priority Data

Jun. 17, 2002 (JP) ..... 2002-175691
Jun. 13, 2003 (JP) ..... 2003-168570
Aug. 8, 2003 (JP) ..... 2003-290713

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS 4,277,791 A 7/1981 Rosenstock et al.
5,211,431 A 5/1993 Koizumi et al.
5,500,664 A 3/1996 Suzuki et al.

(Continued)

FOREIGN PATENT DOCUMENTS

DE 28 12 562 A1 9/1979

(Continued)

OTHER PUBLICATIONS

Combined Search and Examination Report in British appln. No. GB 0424553.6, dated Feb. 1, 2005.

(Continued)

*Primary Examiner*—An H. Do
*Assistant Examiner*—Sarah Al Hashimi
(74) *Attorney, Agent, or Firm*—Stroock & Stroock & Lavan LLP

(57) ABSTRACT

There is disclosed a liquid container that can be removably held in a liquid container accommodation portion by pushing the container in an insertion direction. The liquid container is mounted on a carriage having a container accommodation region. A one-push type fixing member in a position facing a surface parallel to an insertion direction in which the container is inserted into the container accommodation region is engaged with a fixing protrusion forming another one-push type fixing member and cooperating with the first-mentioned one-push type fixing member, so that the container is held in a predetermined position in a state in which the container is resiliently urged by a spring in a direction opposite to the insertion direction.

6 Claims, 28 Drawing Sheets

U.S. PATENT DOCUMENTS

| | | | | |
|---|---|---|---|---|
| 5,642,143 | A | 6/1997 | Rhoads | |
| 5,699,091 | A | 12/1997 | Bullock et al. | |
| 5,745,139 | A | 4/1998 | Sasaki | |
| 5,805,187 | A | 9/1998 | Sasaki | |
| 5,841,453 | A | 11/1998 | Sasaki | |
| 5,949,459 | A | 9/1999 | Gasvoda et al. | |
| 6,070,975 | A | 6/2000 | Uchikata et al. | |
| 6,130,695 | A | 10/2000 | Childers et al. | |
| 6,250,750 | B1 | 6/2001 | Miyazawa et al. | |
| 6,264,314 | B1 | 7/2001 | Mochizuki et al. | |
| 6,276,789 | B1 | 8/2001 | Miyazaki et al. | |
| 6,286,949 | B1 | 9/2001 | Lewis et al. | |
| 6,290,332 | B1 | 9/2001 | Crystal et al. | |
| 6,312,084 | B1 | 11/2001 | Ujita et al. | |
| 6,402,298 | B1 | 6/2002 | Nanjo et al. | |
| 6,431,681 | B2 | 8/2002 | Hatasa et al. | |
| 6,431,697 | B1 | 8/2002 | King et al. | |
| 6,460,982 | B1 | 10/2002 | Ito et al. | |
| 6,471,333 | B1 | 10/2002 | Powell et al. | |
| 6,502,917 | B1 | 1/2003 | Shinada et al. | |
| 6,536,888 | B2 | 3/2003 | Trafton et al. | |
| 6,554,402 | B2 | 4/2003 | Trafton et al. | |
| 6,582,068 | B2 | 6/2003 | Ishizawa et al. | |
| 6,722,762 | B2 | 4/2004 | Miyazawa et al. | |
| 6,749,292 | B2 | 6/2004 | Sturgeon et al. | |
| 6,755,516 | B2 | 6/2004 | Hanson et al. | |
| 6,758,556 | B2 | 7/2004 | Ishizawa et al. | |
| 6,773,100 | B2 | 8/2004 | Kulpa et al. | |
| 6,832,830 | B2 | 12/2004 | Seino et al. | |
| 6,834,945 | B2 | 12/2004 | Ishizawa et al. | |
| 6,843,558 | B2 | 1/2005 | Seino | |
| 6,886,928 | B2 | 5/2005 | Sasaki et al. | |
| 7,293,864 | B2 * | 11/2007 | Kimura et al. | 347/86 |
| 2002/0071011 | A1 | 6/2002 | Hayashi et al. | |
| 2002/0085075 | A1 | 7/2002 | Shinada et al. | |
| 2002/0109761 | A1 | 8/2002 | Shimizu et al. | |
| 2002/0196312 | A1 | 12/2002 | Ishizawa et al. | |
| 2004/0021737 | A1 | 2/2004 | Harada et al. | |
| 2004/0021738 | A1 | 2/2004 | Suganuma | |
| 2004/0212661 | A1 | 10/2004 | Tsuruma | |
| 2005/0036015 | A1 | 2/2005 | Seino et al. | |
| 2005/0116998 | A1 | 6/2005 | Harada et al. | |

FOREIGN PATENT DOCUMENTS

| | | | | |
|---|---|---|---|---|
| DE | 103 27 251 | A1 | | 2/2004 |
| EP | 0 496 642 | A2 | | 7/1992 |
| EP | 0 829 363 | A2 | | 3/1998 |
| EP | 0 997 297 | A1 | | 5/2000 |
| EP | 1 000 749 | A2 | | 5/2000 |
| EP | 1 122 076 | A1 | | 8/2001 |
| EP | 1 177 904 | A1 | | 2/2002 |
| EP | 1 199 179 | A1 | | 4/2002 |
| EP | 1 213 148 | A1 | | 6/2002 |
| EP | 1 323 533 | A2 | | 7/2003 |
| EP | 1 375 159 | A1 | | 1/2004 |
| EP | 1 457 341 | A2 | | 9/2004 |
| EP | 1 623 834 | A1 | | 2/2006 |
| GB | 2 241 201 | | | 8/1991 |
| GB | 2 315 045 | A | | 1/1998 |
| GB | 2 321 623 | A | | 8/1998 |
| GB | 2 343 145 | A | | 5/2000 |
| GB | 2 387 567 | | | 10/2003 |
| GB | 2 391 200 | | | 4/2004 |
| JP | 60-133071 | U | | 9/1985 |
| JP | 61-059054 | U | | 4/1986 |
| JP | 63-271676 | A | | 11/1988 |
| JP | 1-141750 | A | | 6/1989 |
| JP | 3-108557 | A | | 5/1991 |
| JP | 3-197782 | A | | 8/1991 |
| JP | 03-246039 | A | | 11/1991 |
| JP | 04-268686 | A | | 9/1992 |
| JP | 4-119078 | U | | 10/1992 |
| JP | 06-023757 | U | | 3/1994 |
| JP | 08-169121 | A | | 7/1996 |
| JP | 08-169121 | A | | 7/1996 |
| JP | 9-11500 | A | | 1/1997 |
| JP | 9-123479 | | | 5/1997 |
| JP | 09-167033 | A | | 6/1997 |
| JP | 9-309213 | | | 12/1997 |
| JP | 10-006611 | A | | 1/1998 |
| JP | 10-109427 | | | 4/1998 |
| JP | 10-235888 | A | | 9/1998 |
| JP | 2001-277541 | | | 10/2001 |
| JP | 2002-19135 | | | 1/2002 |
| JP | 2002-019227 | A | | 1/2002 |
| JP | 2002-044828 | A | | 2/2002 |
| JP | 2002-127546 | A | | 5/2002 |
| JP | 2002-513340 | A | | 5/2002 |
| JP | 2002-513341 | A | | 5/2002 |
| JP | 2002-254673 | | | 9/2002 |
| JP | 2002273889 | A | * | 9/2002 |
| JP | 2003-341100 | A | | 12/2003 |
| JP | 2004-66490 | A | | 3/2004 |
| JP | 2004-74773 | A | | 3/2004 |
| WO | 98/55318 | A1 | | 12/1998 |
| WO | 98/55324 | A1 | | 12/1998 |
| WO | 99/59823 | | | 11/1999 |
| WO | 01/49499 | A1 | | 7/2001 |
| WO | WO-2004/098895 | A1 | | 11/2004 |

OTHER PUBLICATIONS

Search Report from German Patent Appln. 10 2004 038 382.0-27, dated Mar. 22, 2006 (w/ Engl. translation).

Search Report from Chinese Patent Appln. 200410058408.0, dated May 26, 2006 (w/ Engl. translation).

U.S. Appl. No. 10/912,885, filed Aug. 6, 2004, Kimura et al.

U.S. Appl. No. 11/026,191, filed Dec. 30, 2004, Harada et al.

* cited by examiner

INKJET RECORDING APPARATUS AND INK CARTRIDGE

CROSS-REFERENCE TO RELATED APPLICATIONS

This application is a continuation-in-part of application Ser. No. 10/462,942, filed on Jun. 17, 2003now U.S. Pat No. 7,018,027, and a continuation-in-part of application Ser. No. 10/882,528, filed on Jun. 30, 2004now abandoned.

BACKGROUND OF THE INVENTION

1. Field of the Invention

The present invention relates to an inkjet recording apparatus fitted with a recording head for ejecting droplets of ink onto a recording medium in response to a print signal and also to a liquid container used in this inkjet recording apparatus.

2. Description of the Related Art

An inkjet recording apparatus has a recording head for ejecting droplets of ink. This head is mounted on a carriage that reciprocates relative to a recording medium. The recording apparatus currently available is so designed that ink is supplied to the recording head from an ink cartridge via an ink channel such as a tube or that ink is supplied to the recording head via an ink supply needle formed on the carriage where an ink cartridge is mounted.

Either of these types employs an arrangement in which an ink leading-out member, such as the ink supply needle, of the main body side is inserted into or connected to an ink supply port of the ink cartridge, and therefore the ink cartridge and the ink leading-out member must be reliably connected and fixed to each other so as to avoid an unintentional disconnection therebetween. To this end, it is necessary to provide a member for fixing the ink cartridge to the cartridge accommodation portion in the related art.

The arrangement using the aforementioned fixing member, however, requires two operations, i.e. mounting an ink supply port of the ink cartridge to a coupling member formed at an end of the ink supply path, and thereafter fixing the cartridge by the fixing member. Consequently, the sequence of operations for mounting is cumbersome to perform. Further, the fixing member is required to make the structure complicated.

The present invention relates to a liquid container which stores liquid to be supplied to a liquid consuming apparatus therein, and is removably mountable to a container mounting part of the liquid consuming apparatus.

The liquid consuming apparatus includes, as a representative example thereof, a liquid ejecting apparatus, which ejects a liquid droplet from an ejection head. This liquid ejecting apparatus includes, as a representative example thereof, an ink jet type recording apparatus provided with an ink jet type recording head for recording an image. Other examples of the liquid ejecting apparatus include, for example, an apparatus having color material ejection head used in manufacture of a color filter of a liquid crystal display or the like, an apparatus having an electrode material (conductive paste) ejection head used in electrode formation of an organic EL display, a field emission display (FED) or the like, an apparatus having bioorganic matter ejection head used in biochip manufacture, and an apparatus having a sample ejection head as a precision pipette.

The ink jet type recording apparatus that is representative of the liquid jet apparatus is comparatively less noisy in printing, and can form fine dots with high density. Therefore, the ink jet type recording apparatus is presently used in various printing including color printing.

As a liquid supply system to the liquid consuming apparatus of which the ink jet type recording apparatus is representative, such a system is available, in which the liquid is supplied from a liquid container that stores the liquid therein to the liquid consuming apparatus. Further, in this liquid supply system using the liquid container, the liquid container is generally constituted as a cartridge removably mountable to the liquid consuming apparatus so that a user can exchange the liquid container easily when the liquid in the liquid container is consumed.

Generally, the ink jet type recording apparatus has a carriage that is equipped with a recording head for ejecting an ink droplet and reciprocates along a recording surface of a recording medium. As an ink supply system from the ink cartridge to the recording head, there is a system in which the ink cartridge is mounted on the carriage and the ink is supplied to the recording head from the ink cartridge reciprocating together with the recording head. Further, as another system, there is a system in which the ink cartridge is mounted onto a case or the like of an apparatus body and the ink is supplied through an ink flowing path formed by a flexible tube or the like from the ink cartridge to the recording head.

In any of the above ink supply systems, it is necessary to mount and fix the ink cartridge in a predetermined position of the apparatus body readily and surely. Further, in exchange of the ink cartridge, it is necessary to remove the ink cartridge from the apparatus body readily and surely.

Therefore, the conventional ink jet type recording apparatus and ink cartridge employ, as a mechanism for surely fixing the ink cartridge in the predetermined position of the apparatus body, for example, a mechanism in which the ink cartridge is pressed and fixed by a fixing lever operated after the ink cartridge is inserted into a cartridge holder of the apparatus body.

Patent Reference 1: W099/59823

However, such cartridge fixing mechanism requires separate steps performed independently, i.e. an insertion step of the ink cartridge into the cartridge holder and a fixing step by operating the fixing lever after insertion, so that the mounting operation of the ink cartridge to the apparatus body is complicated. Further, this conventional cartridge fixing mechanism also requires two-step operation when the ink cartridge is removed.

Further, such a mechanism is conceivable that realizes fixing of the ink cartridge simultaneously with the insertion step during mounting, but even this case requires a step of releasing the fixing when the ink cartridge is removed. This fixing release step must be performed completely independently of a subsequent operation of pulling out the ink cartridge. Therefore, the removing operation of the ink cartridge becomes complicated.

Further, in the conventional ink jet type recording apparatus and ink cartridge, there are those of such constitution that a memory element (IC) storing data such as the kind of ink and the residual ink amount is provided for the ink cartridge, and an apparatus-side contact to be connected to an IC side electrode is provided on the apparatus body side (for example, cartridge holder).

In a case that the ink cartridge having such IC is mounted onto the apparatus body, it is necessary to surely connect the IC-side electrode to the apparatus-side contact when the ink cartridge is mounted to the apparatus body, and further to surely maintain its connection state. Namely, it is necessary to suppress deviation between the apparatus-side contact and the IC-side electrode in a range enabling electric conduction. For example, it is conceivable to make the dimension of the IC-side electrode larger, to thereby make larger a permissible range of the deviation with respect to the apparatus-side contact. However, this results in a problem that the ink cartridge itself is also larger in size with size increase of the IC-side electrode.

The invention has been made in view of the above circumstances, and its object is to provide a liquid container, which can be mounted onto a liquid consuming apparatus readily and surely.

SUMMARY OF THE INVENTION

In view of these problems, the present invention has been made. It is an object of the present invention to provide an inkjet recording apparatus permitting a liquid container to be fixed to a container n ink cartridge accommodation portion simply by pushing-in the liquid container in the mounting direction.

It is another object of the invention to provide a liquid container adapted for the recording apparatus described above.

It is also an object of the invention to provide a method for installing a container in a printer, and a method of removing the container from the printer.

Accordingly to accomplish these and other objects, the following are proposed.

A liquid container has a container body with a surface, the surface having a recess, the recess having a bottom and a perimeter wall, a guide projection disposed within the recess, at least a portion of the guide projection extending from the bottom of the recess toward the surface, wherein, viewing the guide projection in a direction perpendicular to the bottom of the recess, the guide projection has at least three edges. The perimeter wall and edges of the guide projection define a path therebetween, and the path has at least a predetermined width.

A liquid container includes a container body with a surface, the surface having a recess, the recess having a bottom, and a perimeter wall, a guide projection disposed within the recess, at least a portion of the guide projection extending from the bottom of the recess toward the surface, so that the perimeter wall and the guide projection define a path therebetween. The path has a flat first floor section leading to a sloped second floor section leading to a flat third floor section leading to a sloped fourth floor section leading to a flat fifth floor section.

A liquid container includes a container body with a front surface having a first opening extending inward into the liquid container along a first line and a second opening extending inward into the liquid container along a second line approximately parallel to the first line, and a bottom surface, the bottom surface having a recess, the recess having a bottom and a perimeter wall. A guide projection is disposed within the recess, and at least a portion of the guide projection extends from the bottom of the recess toward the bottom surface. Viewed in a direction perpendicular to the front surface, the first and the second lines lie in a plane parallel to at least a portion of the bottom surface and at least a portion of the bottom of the recess is parallel to the plane.

A liquid container has a container body including a front surface having a first opening extending inward into the liquid container along a first line and a second opening extending inward into the liquid container along a second line approximately parallel to the first line, and a bottom surface, the bottom surface having a recess, the recess having a bottom and a perimeter wall. A guide projection is disposed within the recess, and at least a portion of the guide projection extends from the bottom of the recess toward the bottom surface. Viewed in a direction perpendicular to the front surface, the first and the second openings lie in a plane parallel to at least a portion of the bottom surface and at least a portion of the bottom of the recess is parallel to the plane.

An liquid container can have a generally-rectangular container body with an interior and a bottom surface, the bottom surface having a recess, the recess having a bottom and a perimeter wall, a front surface and a side surface, the bottom surface, the front surface and the side surface lying in respective intersecting perpendicular planes. A guide projection is disposed within the recess, and at least a portion of the guide projection extends from the bottom of the recess toward the surface. Viewing the guide projection in a direction perpendicular to the bottom of the recess, the guide projection has at least three edges. A liquid supply port communicates with the interior of the container body, the liquid supply port being located in the front surface, and an air opening is in fluid communication with the interior of the container, the air opening being located in the front surface. A first positioning hole and a second positioning hole are located in the front surface. The perimeter wall and edges of the guide projection define a path therebetween, and the path has at least a predetermined width.

Another liquid container has a generally-rectangular container body with an interior and a bottom surface, the bottom surface having a recess, the recess having a bottom and a perimeter wall, a front surface and a side surface, the bottom surface, the front surface and the side surface lying in respective intersecting perpendicular planes, a guide projection disposed within the recess, at least a portion of the guide projection extending from the bottom of the recess toward the surface, and a liquid supply port communicating with the interior of the container body, the liquid supply port being located in the front surface. An air opening is in fluid communication with the interior of the container, the air opening being located in the front surface, and first and second positioning holes are located in the front surface. The perimeter wall and guide projection define a path therebetween, the path having a flat first floor section leading to a sloped second floor section leading to a flat third floor section leading to a sloped fourth floor section leading to a flat fifth floor section.

Another liquid container has a generally-rectangular container body with an interior, a bottom surface, the bottom surface having a recess, the recess having a bottom and a perimeter wall, a front surface having a first opening extending inward into the liquid container along a first line and a second opening extending inward into the liquid container along a second line approximately parallel to the first line, and a side surface, the bottom surface, the front surface and the side surface lying in respective intersecting perpendicular planes. The container also includes a guide projection disposed within the recess, at least a portion of the guide projection extending from the bottom of the recess toward the bottom surface, so that, viewed in a direction perpendicular to the front surface, the first and the second lines lie in a plane parallel to at least a portion of the bottom surface and at least a portion of the bottom of the recess is parallel to the plane.

A liquid container also includes a generally-rectangular container body having an interior, a front surface having a first opening extending inward into the ink cartridge along a first line and a second opening extending inward into the ink cartridge along a second line approximately parallel to the first line, and a bottom surface, the bottom surface having a recess, the recess having a bottom and a perimeter wall, the bottom surface, the front surface and the side surface lying in respective intersecting perpendicular planes, and a guide projection disposed within the recess. At least a portion of the guide projection extends from the bottom of the recess toward the bottom surface, and, viewed in a direction perpendicular to the front surface, the first and the second openings lie in a plane parallel to at least a portion of the bottom surface and at least a portion of the bottom of the recess is parallel to the plane.

A liquid container has a generally-rectangular container body with an interior and a bottom surface, the bottom surface having a recess, the recess having a bottom surface and a perimeter wall, a front surface and a side surface, the bottom surface, the front surface and the side surface lying in respective intersecting perpendicular planes, a guide projection disposed within the recess, at least a portion of the guide projection extending from the bottom of the recess toward the surface, so that, viewing the guide projection in a direction perpendicular to the bottom surface of the recess, the guide projection has at least first, second and third edges. A liquid supply port communicates with the interior of the container body, the liquid supply port being located in the front surface, and the container also has first and second positioning holes, the first and second positioning holes being located in the front surface so that the liquid supply port is located between the first and second positioning holes, and a memory device having an electrode, the memory device being mounted on the side surface. The recess, memory device and one of the first and second positioning holes are located proximate to a corner defined by the intersecting perpendicular planes, and the perimeter wall and edges of the guide projection define a path therebetween, the path including an entrance-side guide part, an intermediate guide part, a fixing part, and an exit-side guide part. The entrance-side guide part is defined at least in part by the first edge of the guide projection, the first edge of the guide projection being inclined relative to the front and side surfaces and perpendicular to the bottom surface, the intermediate guide part is defined at least in part by first and second portions of the perimeter wall, the first portion of the perimeter wall being perpendicular to the side and bottom surfaces and parallel to the front surface, the second portion of the perimeter wall extending from the first portion of the perimeter wall toward the second edge of the guide projection, and being perpendicular to the bottom and front surfaces and parallel to the side surface. The fixing part is defined at least in part by first and second portions of the second edge of the guide projection, the first portion of the second edge being perpendicular to the side and bottom surfaces and parallel to the front surface, the second portion of the second edge extending outwardly from the first portion of the second edge and being perpendicular to the bottom and front surfaces and parallel to the side surface. The exit-side guide part is defined at least in part by third and fourth portions of the perimeter wall, the third portion of the perimeter wall being perpendicular to the bottom and side surfaces and parallel to the front surface, the fourth portion of the perimeter wall extending from the third portion of the perimeter wall along the third edge of the guide projection and being perpendicular to the bottom and front surfaces and parallel to the side wall. An end of the entrance side guide part and an end of the exit-side guide part are connected together by a step.

According to this invention, there is a liquid container mountable to a mounting part of an ink jet recording apparatus, the mounting part including a fixing pin, a first biasing member for applying a first biasing force to the pin in a first direction, and a second biasing member for applying a second biasing force to the liquid container, inserted into the mounting part in an insertion direction, in a second direction opposite from the insertion direction and perpendicular to the first direction. The liquid container has a generally-rectangular container body with an interior and a bottom surface, the bottom surface having a recess, the recess having a bottom surface and a perimeter wall, a front surface and a side surface, the bottom surface, the front surface and the side surface lying in respective intersecting perpendicular planes, a guide projection disposed within the recess, at least a portion of the guide projection extending from the bottom of the recess toward the surface, wherein, viewing the guide projection in a direction perpendicular to the bottom surface of the recess, the guide projection has at least first, second and third edges, and a liquid supply port communicates with the interior of the container body, the liquid supply port being located in the front surface. The container also has first and second positioning holes located in the front surface so that the liquid supply port is located between the first and second positioning holes. A memory device has an electrode, the memory device being mounted on the side surface. The recess, the memory device and one of the first and second positioning holes are located proximate to a corner defined by the intersecting perpendicular planes. The perimeter wall and edges of the guide projection define a path therebetween for permitting the pin to pass therethrough, the path including an entrance-side guide part, an intermediate guide part, a fixing part, and an exit-side guide part, and the entrance-side guide part is defined at least in part by the first edge of the guide projection, the first edge of the guide projection being for guiding the pin against the first biasing force when the ink cartridge is inserted into the mounting part against the second biasing force. The intermediate guide part is defined at least in part by first and second portions of the perimeter wall, the first portion of the perimeter wall defining a first fully inserted position of the ink cartridge upon contact with the pin when the ink cartridge is inserted into the mounting part against the second biasing force, the second portion of the perimeter wall being for stopping the pin against the first biasing force when the ink cartridge is positioned at the first fully inserted position, and the fixing part is defined at least in part by first and second portions of the second edge of the guide projection, the first portion of the second edge being for holding the ink cartridge against the second biasing force upon contact with the pin when the liquid container is moved from the first fully inserted position to a predetermined fixing position by the second biasing force, the second portion of the second edge being for holding the pin against the first biasing force when the liquid container is moved from the first fully inserted position to the predetermined fixing position by the second biasing force. The exit-side guide part is defined at least in part by third and fourth portions of the perimeter wall, the third portion of the perimeter wall being for defining a second fully inserted position of the liquid container upon contact with the pin when the liquid container is moved from the predetermined fixing position against the second biasing force, the fourth portion of the perimeter wall being for guiding the pin against the first biasing force and for moving the liquid container from the second fully inserted position using the second biasing force. Ends of the entrance side guide part and of the exit-side guide part are connected together by a step for preventing the pin from directly entering into the exit-side guide part and for guiding the pin into the entrance side guide part.

Also, a liquid container can include a container body having first and second walls, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, a guide structure disposed within the recess, at least a portion of the guide structure extending from the floor of the recess toward the first wall, and a first slanted surface that is inclined from a first part of the floor of the recess toward the first wall, the first slanted surface being located between the guide structure and the perimeter wall.

A liquid container also can include a container body with first and second walls, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within and occupying a portion of the recess, at least a portion of the guide structure extending from the floor of the recess toward the first wall, the guide structure having a first side wall, a second side wall leading from the first side wall and a third side wall leading from the second side wall, the guide structure being sized so that there is a path of at least a minimum width between the perimeter wall and the first side wall, the second side wall and the third side wall.

Another aspect of this invention involves an inkjet printer having a reciprocable carriage assembly with a container holder with a bottom and an interior, and a projection having a movable tip portion extending into the interior of the container holder, a liquid jet recording head, a liquid supply needle extending upward from the bottom toward the interior of the container holder, and a fluid path between the liquid supply needle and the liquid jet recording head.

Also, a liquid jet printer can include a liquid container with a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within the recess, at least a portion of the guide structure extending from the floor of the recess toward the first wall. Also, there is a first slanted surface inclined from a first part of the floor of the recess toward the first wall, the first slanted surface being located between the guide structure and the perimeter wall, and a reciprocable carriage assembly having a container holder with a bottom and an interior, the container holder accommodating the liquid container, and a projection having a movable tip portion extending into the interior of the container holder, the movable tip portion being located within the recess. The printer further includes a liquid jet recording head, a liquid supply needle extending upward from the bottom toward the interior of the container holder, and a fluid path between the interior of the liquid container, the liquid supply needle and the liquid jet recording head.

A liquid jet printer can include a liquid container with a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within and occupying a portion of the recess, at least a portion of the guide structure extending from the floor of the recess toward the first wall, the guide structure having a first side wall, a second side wall leading from the first side wall and a third side wall leading from the second side wall, the guide structure being sized so that there is a path of at least a minimum width between the perimeter wall and the first side wall, the second side wall and the third side wall. The printer includes a reciprocable carriage assembly having a container holder with a bottom and an interior, the container holder accommodating the liquid container, and a projection having a movable tip portion extending into the interior of the container holder, the movable tip portion being located within the recess, a liquid jet recording head, a liquid supply needle extending upward from the bottom toward the interior of the container holder, and a fluid path between the interior of the liquid container, the liquid supply needle and the liquid jet recording head.

Furthermore, this invention is directed to a method of installing a liquid container in a printer by providing the liquid container, the liquid container having a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, a guide structure disposed within and occupying a portion of the recess, at least a portion of the guide structure extending from the floor of the recess toward the first wall, the guide structure being shaped to define a path, the path having a rest portion, and a first slanted surface that is inclined from a first part of the floor of the recess toward the first wall, the first slanted surface being located between the guide structure and the perimeter wall. The method also involves providing the printer, which has a reciprocable carriage assembly with a container holder with a bottom and an interior, the container holder accommodating the liquid container, and a projection having a movable tip portion extending into the interior of the container holder, a liquid jet recording head, a liquid supply needle extending upward from the bottom toward the interior of the container holder, and a fluid path between the interior of the liquid container, the liquid supply needle and the inkjet recording head. The method also involves inserting the liquid container into the container holder in an insertion direction so that the movable tip portion passes between the guide structure and the perimeter wall, and releasing the liquid container. Following the releasing step, the movable tip portion is located at the rest portion.

According to the present invention, a method of installing a liquid container in a printer involves providing the liquid container, the liquid container having a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within and occupying a portion of the recess, at least a portion of the guide structure extending from the floor of the recess toward the first wall, the guide structure having a first side wall, a second side wall leading from the first side wall and a third side wall leading from the second side wall, the guide structure being sized so that there is a path of at least a minimum width between the perimeter wall and the first side wall, the second side wall and the third side wall, the path having a rest portion. Other steps of the method include providing the printer, the printer having a reciprocable carriage assembly having a container holder with a bottom and an interior, the container holder accommodating the liquid container, and a projection having a movable tip portion extending into the interior of the container holder, the movable tip portion being located within the recess, a liquid jet recording head, a liquid supply needle extending upward from the bottom toward the interior of the container holder, and a fluid path between the interior of the liquid container, the liquid supply needle and the liquid jet recording head, inserting the liquid container into the container holder in an insertion direction so that the movable tip portion passes through a portion of the path of at least the minimum width, and releasing the liquid container. Following the releasing step, the movable tip portion is located at the rest portion.

In accordance with this invention, a method of removing a liquid container from a printer includes the steps of providing the liquid container, the liquid container having a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within and occupying a portion of the recess, at least a portion of the guide structure extending from the floor of the recess toward the first wall, the guide structure being shaped to define a path, the path having a rest portion, and a first slanted surface that is inclined from a first part of the floor of the recess toward the first wall, the first slanted surface being located between the guide structure and the perimeter wall. The method also involves providing the printer, the printer having a reciprocable carriage assembly having a container holder with a bottom and an interior, the container holder accommodating the liquid container when the liquid container is inserted along an insertion direction into the container holder, and a projection having a movable tip portion extending into the interior of the container holder, the movable tip being located at the rest portion of the path, a liquid jet recording head, a liquid supply needle extending upward from the bottom toward the interior of the container holder, and a fluid path between the interior of the liquid container, the liquid supply needle and the liquid jet recording head. Other steps involve urging the liquid container further into the container holder in the insertion direction so that the movable tip portion passes leaves the rest portion and advances along the path between the guide structure and the perimeter wall, and releasing the liquid container.

Yet another aspect of this invention is a method of removing a liquid container in a printer. This is done by providing the liquid container, the liquid container having a container body having a first wall and a second wall, the first wall lying in a first plane and the second wall lying in a second plane that intersects the first plane, the container body having an interior, a liquid supply port formed in the second wall, a recess formed in the first wall, the recess including a floor lying in a plane parallel to the first plane and a perimeter wall, and a guide structure disposed within and occupying a portion of the recess, at least a portion of the guide structure extending from the floor of the recess toward the first wall, the guide structure having a first side wall, a second side wall leading from the first side wall and a third side wall leading from the second side wall, the guide structure being sized so that there is a path of at least a minimum width between the perimeter wall and the first side wall, the second side wall and the third side wall, the path having a rest portion. Other steps include providing the printer, the printer having a reciprocable carriage assembly having a container holder with a bottom and an interior, the container holder accommodating the liquid container when the liquid container is inserted along an insertion direction into the container holder, and a projection having a movable tip portion extending into the interior of the container holder, the movable tip portion being located within the recess, a liquid jet recording head, a liquid supply needle extending upward from the bottom toward the interior of the container holder, and a fluid path between the interior of the liquid container, the; the liquid supply needle and the liquid jet recording head, as well as urging the liquid container further into the container holder in the insertion direction so that the movable tip portion passes leaves the rest portion and advances along the path between the guide structure and the perimeter wall, and releasing the liquid container.

The present disclosure relates to the subject matter contained in Japanese patent application No. 2003-290713 filed on Aug. 8, 2003, which is expressly incorporated herein by reference in its entirety.

xxx

Figure 14:
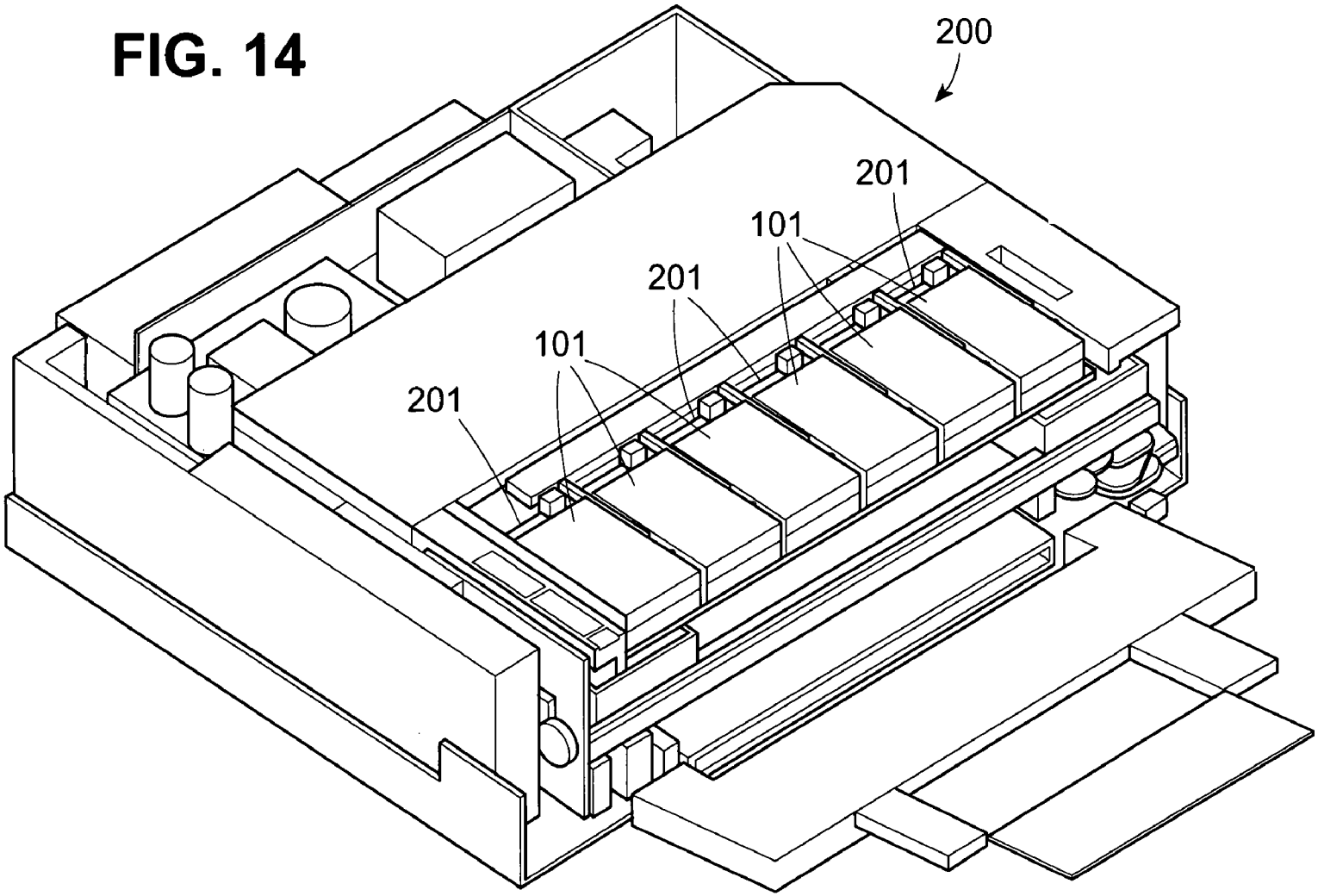

FIG. 14 is a perspective view showing an ink cartridge according to one embodiment of the invention and a cartridge mounting part of an ink jet type recording apparatus to which this ink cartridge is mounted.

Figure 15C:
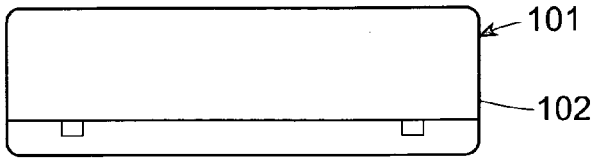
Figure 15A:
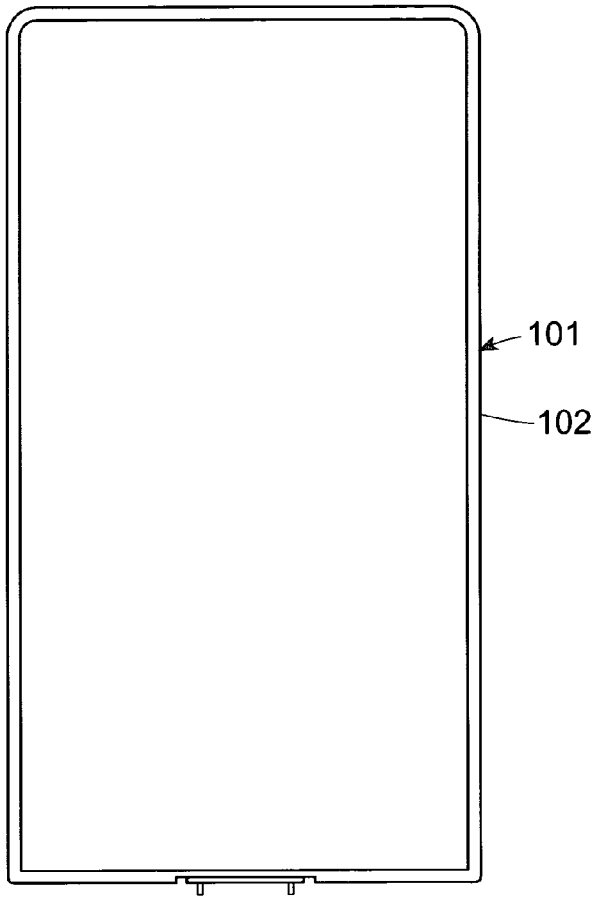
Figure 15B:
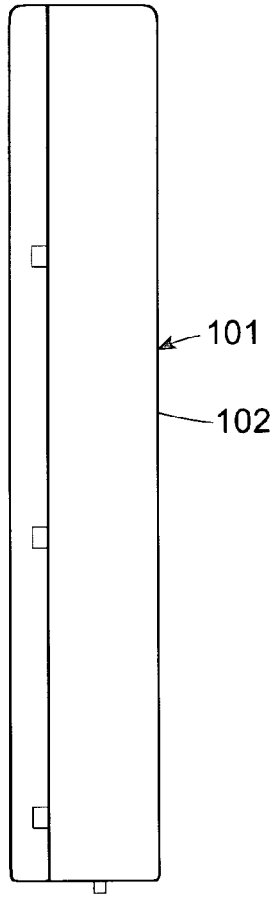
Figure 15D:
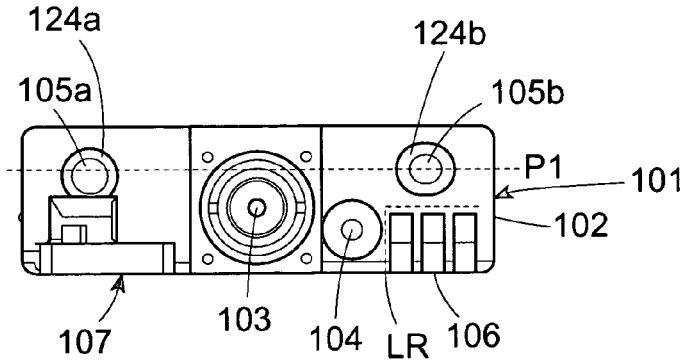

FIGS. 15A to 15D are diagrams showing the ink cartridge according to the embodiment of the invention, in which FIG. 15A is a plan view, FIG. 15B is a side view, FIG. 15C is a rear view, and FIG. 15D is a front view.

Figure 16A:
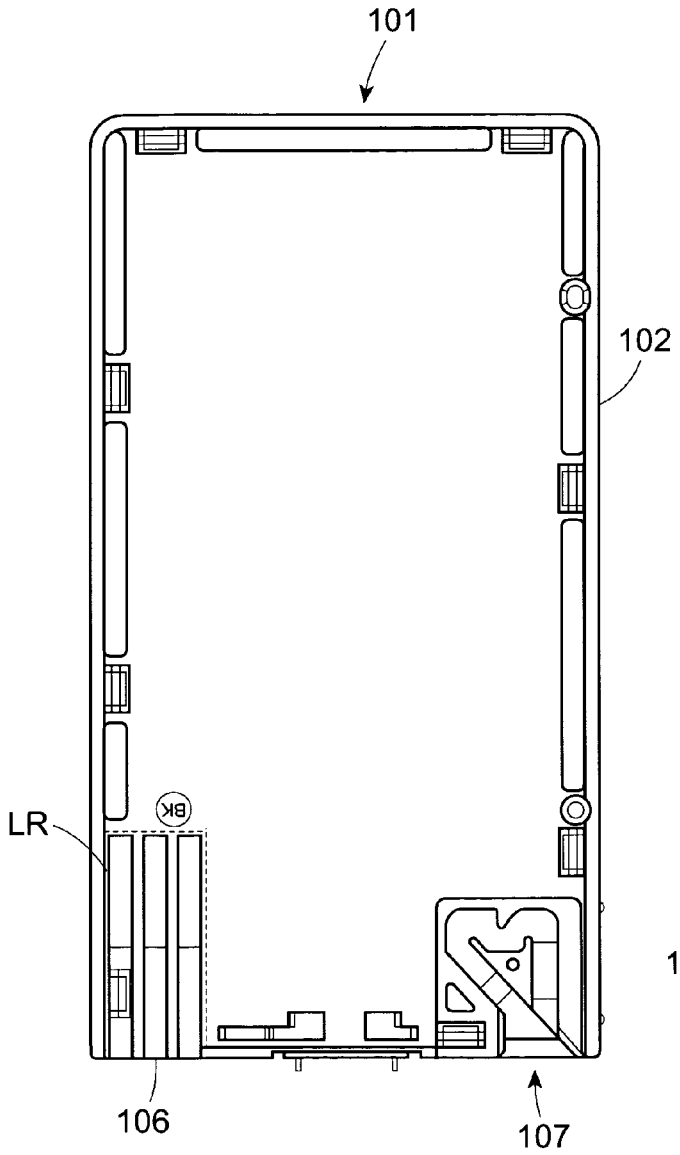
Figure 16B:
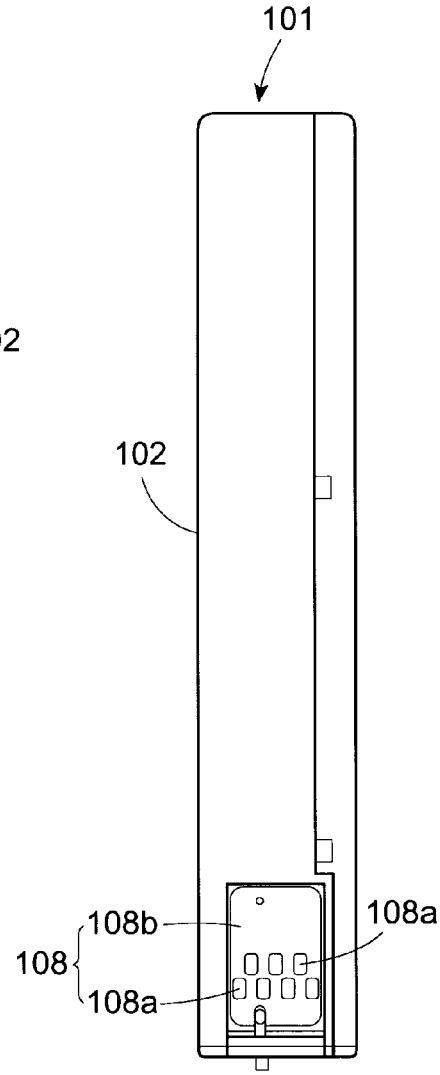

FIGS. 16A and 16B are diagrams showing the ink cartridge according to the embodiment of the invention, in which FIG. 16A is a bottom view, and FIG. 16B is a side view.

Figure 17C:
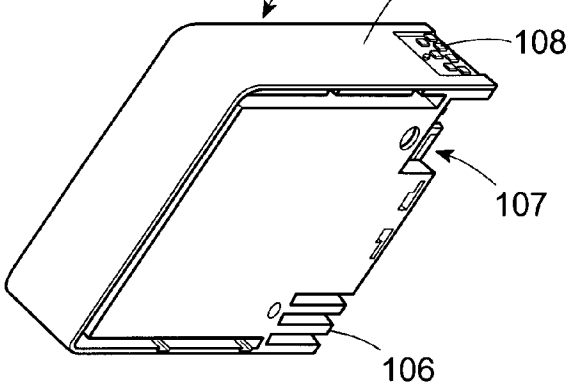
Figure 17D:
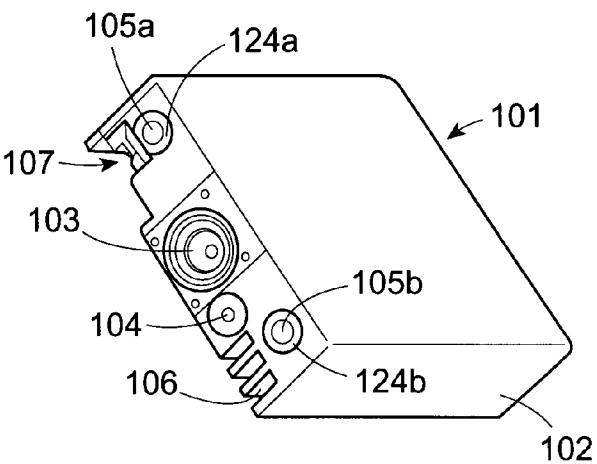
Figure 17A:
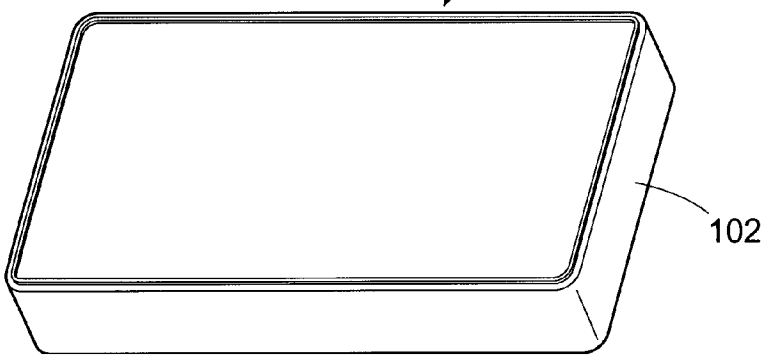
Figure 17B:
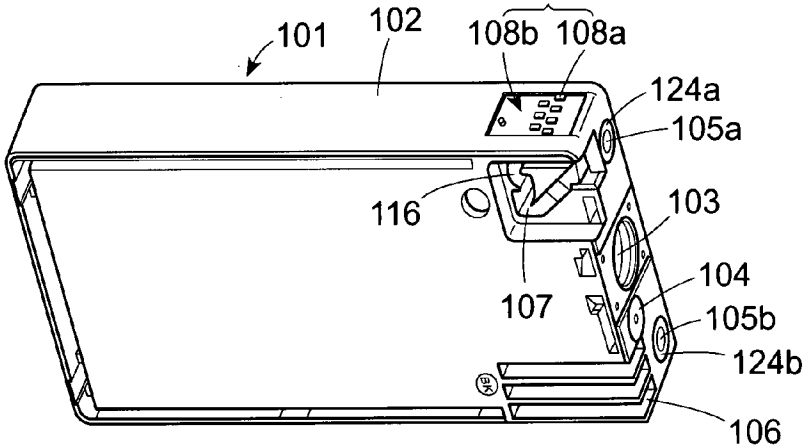

FIGS. 17A to 17D are perspective views showing the ink cartridge according to the embodiment of the invention, in which FIG. 17A is a diagram viewed in a direction where a diagonally upward back surface can be seen, FIG. 17B is a diagram viewed in a direction where a diagonally downward front surface can be seen, FIG. 17C is a diagram viewed in a direction where a diagonally downward back surface can be seen, and FIG. 17D is a diagram viewed in a direction where a diagonally upward front surface can be seen.

Figure 18:
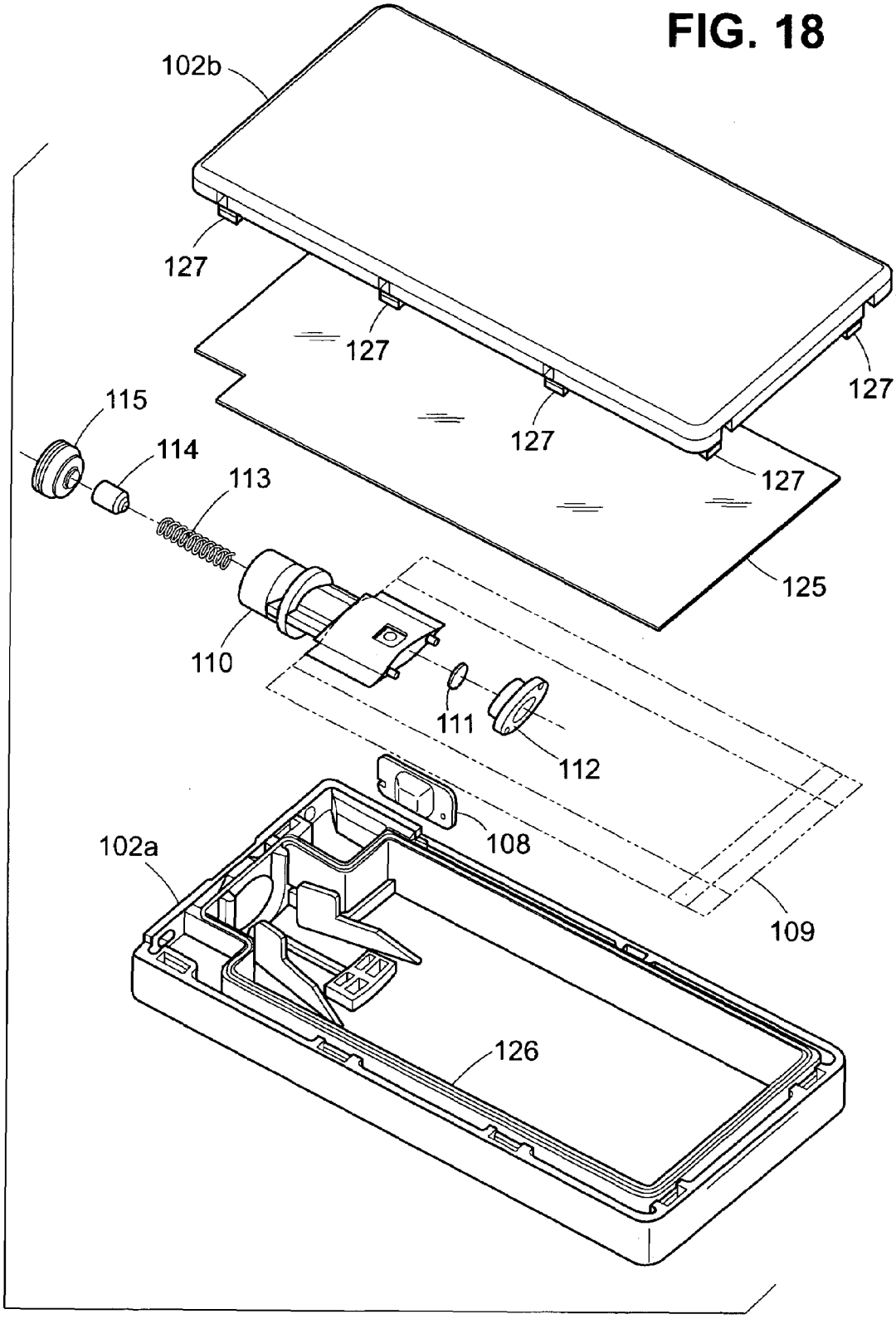

FIG. 18 is an exploded perspective view of the ink cartridge according to the embodiment of the invention.

Figure 19D:
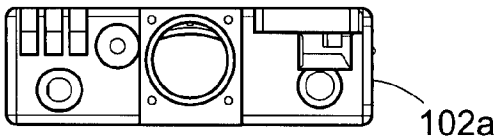
Figure 19C:
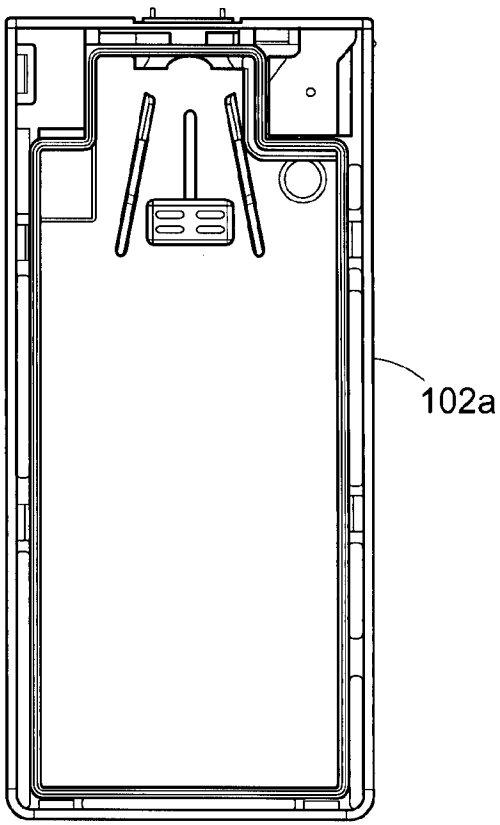
Figure 19B:
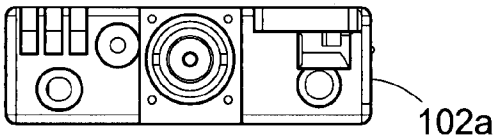
Figure 19A:
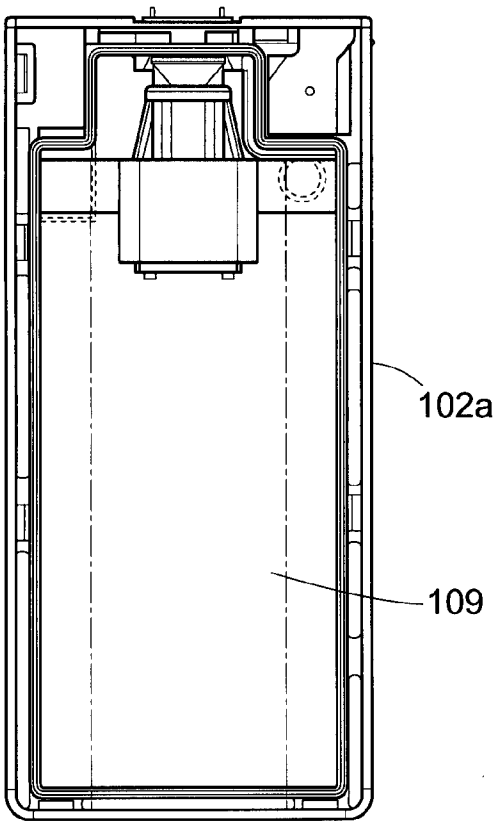

FIGS. 19A to 19D are diagrams showing a state in which a lid member is removed from the ink cartridge according to the embodiment of the invention, in which FIG. 19A is a plan view in a state where an ink bag is housed, FIG. 19B is a front view of FIG. 19A, FIG. 19C is a plan view in a state where the ink bag is not housed, and FIG. 19D is a front view of FIG. 19C.

Figure 20:
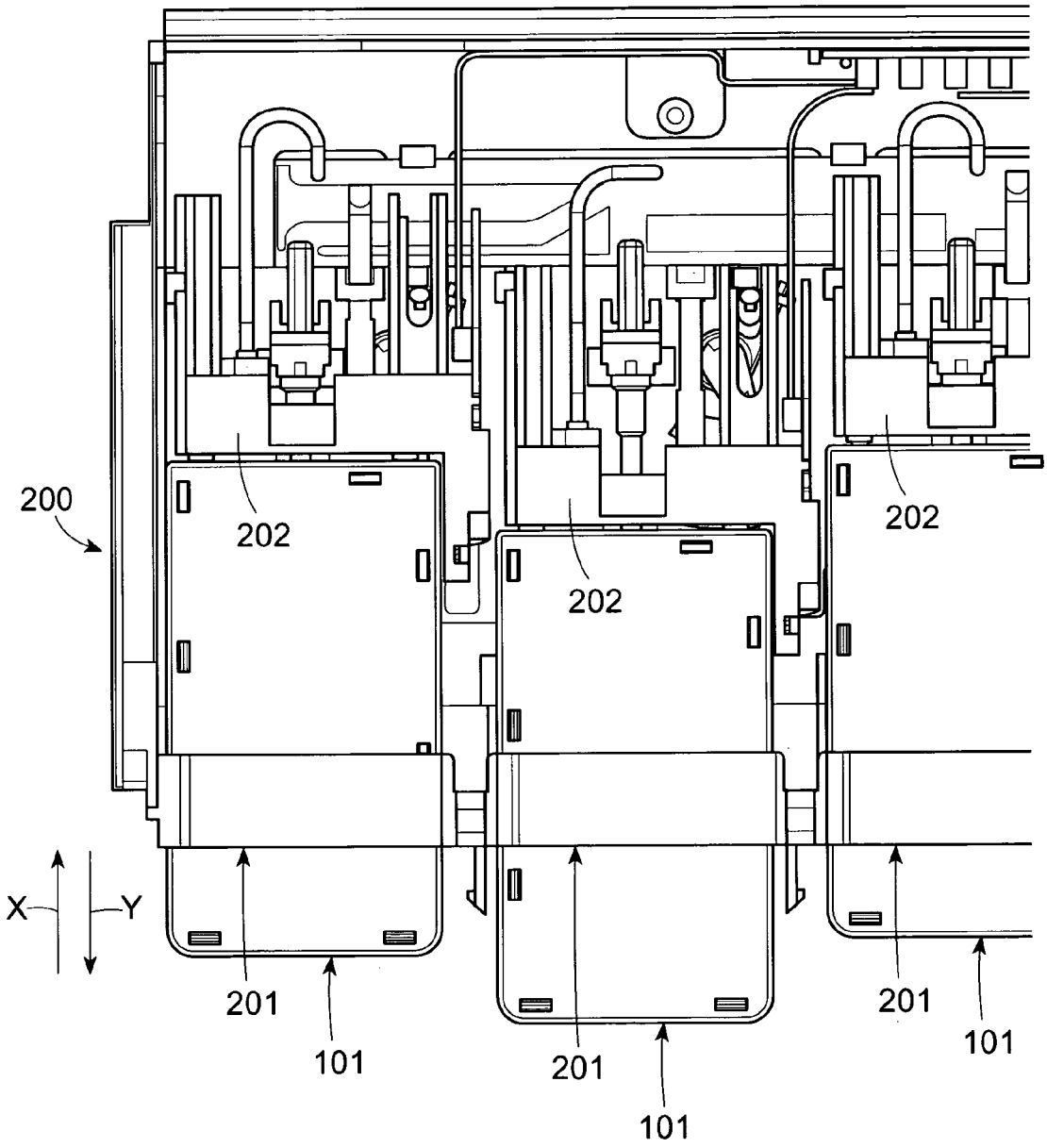

FIG. 20 is a plan view showing a state where the ink cartridge according to the embodiment of the invention is mounted to the cartridge mounting part of the ink jet type recording apparatus so as to show the apparatus inside.

Figure 21:
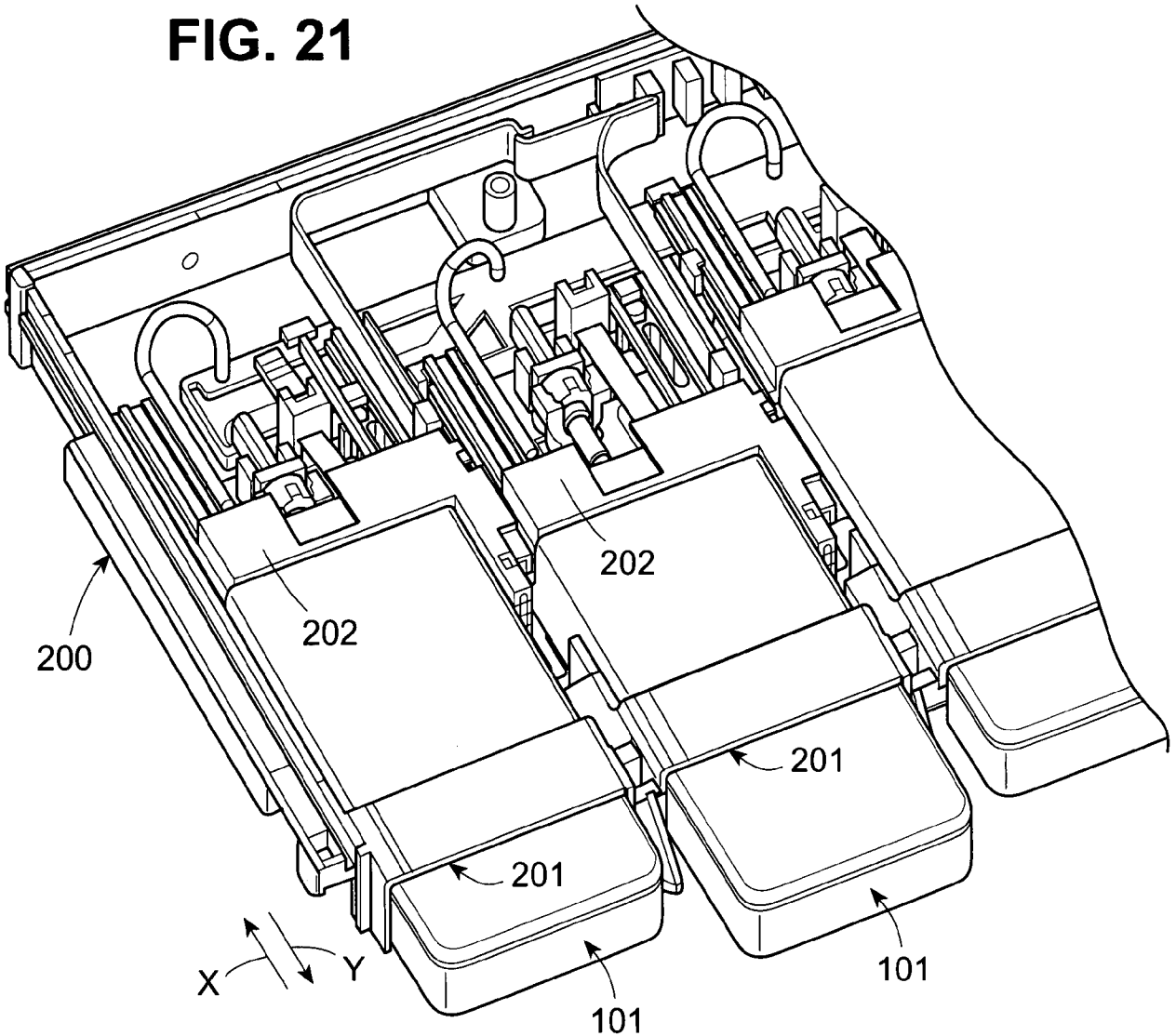

FIG. 21 is a perspective view showing the state where the ink cartridge according to the embodiment of the invention is mounted to the cartridge mounting part of the inkjet type recording apparatus so as to show the apparatus inside.

Figure 22:
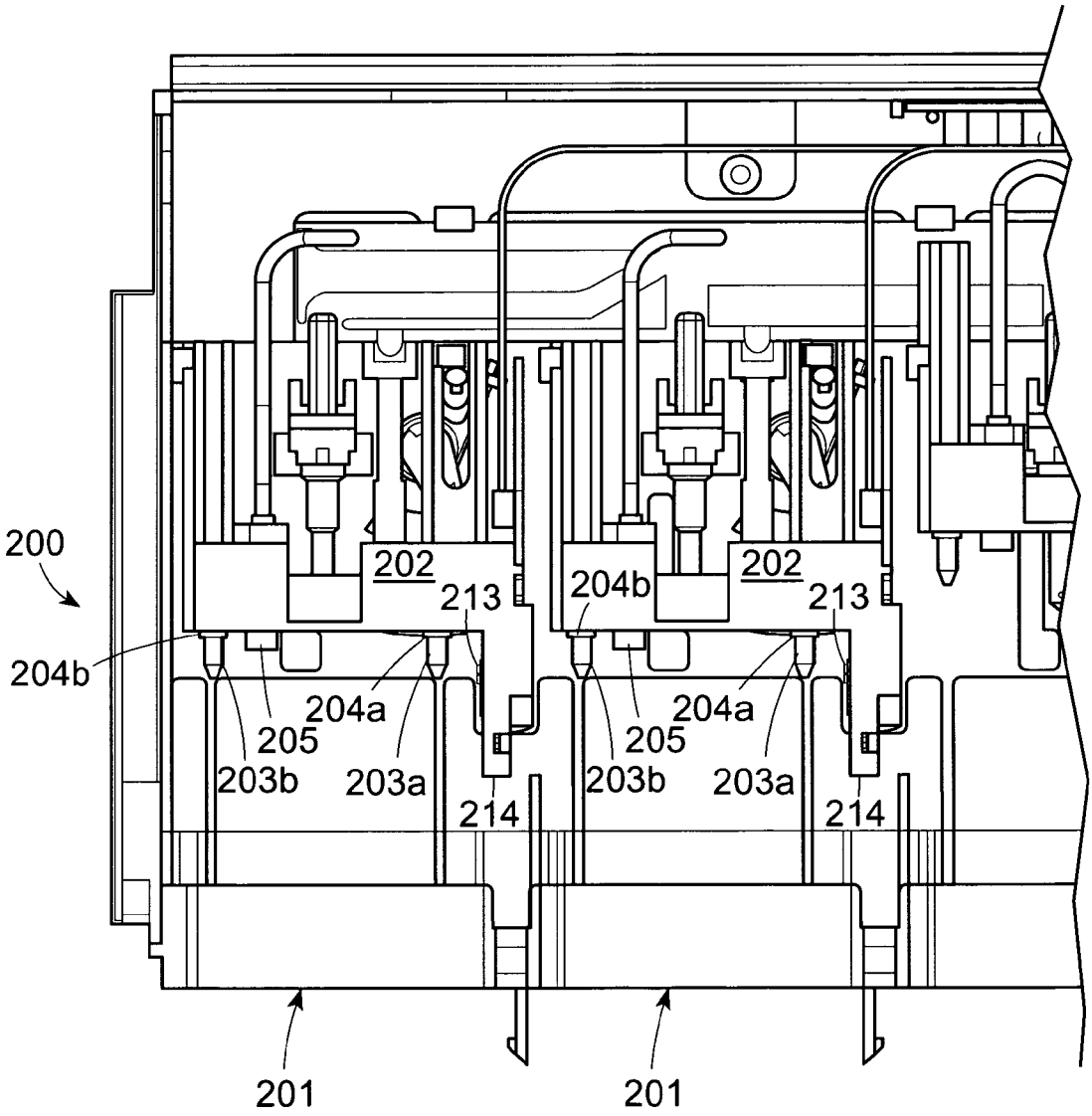

FIG. 22 is a plan view showing the cartridge mounting part of the ink jet type recording apparatus shown in FIG. 20 in a state where the ink cartridge has not been mounted yet so as to show the apparatus inside.

Figure 23:
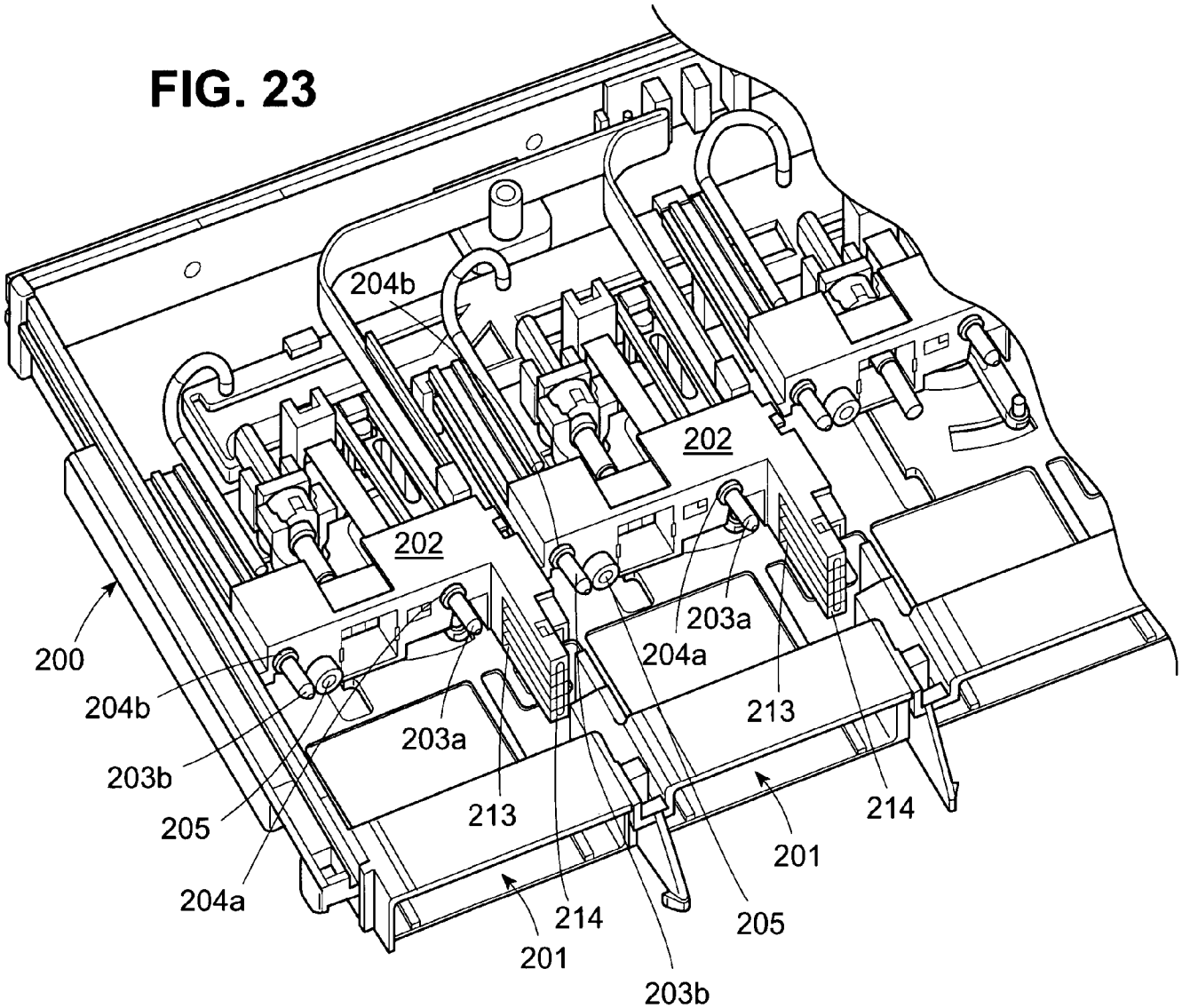

FIG. 23 is a perspective view showing the cartridge mounting part of the ink jet type recording apparatus shown in FIG. 21 in the state where the ink cartridge has not been mounted yet so as to show the apparatus inside.

Figure 24B:
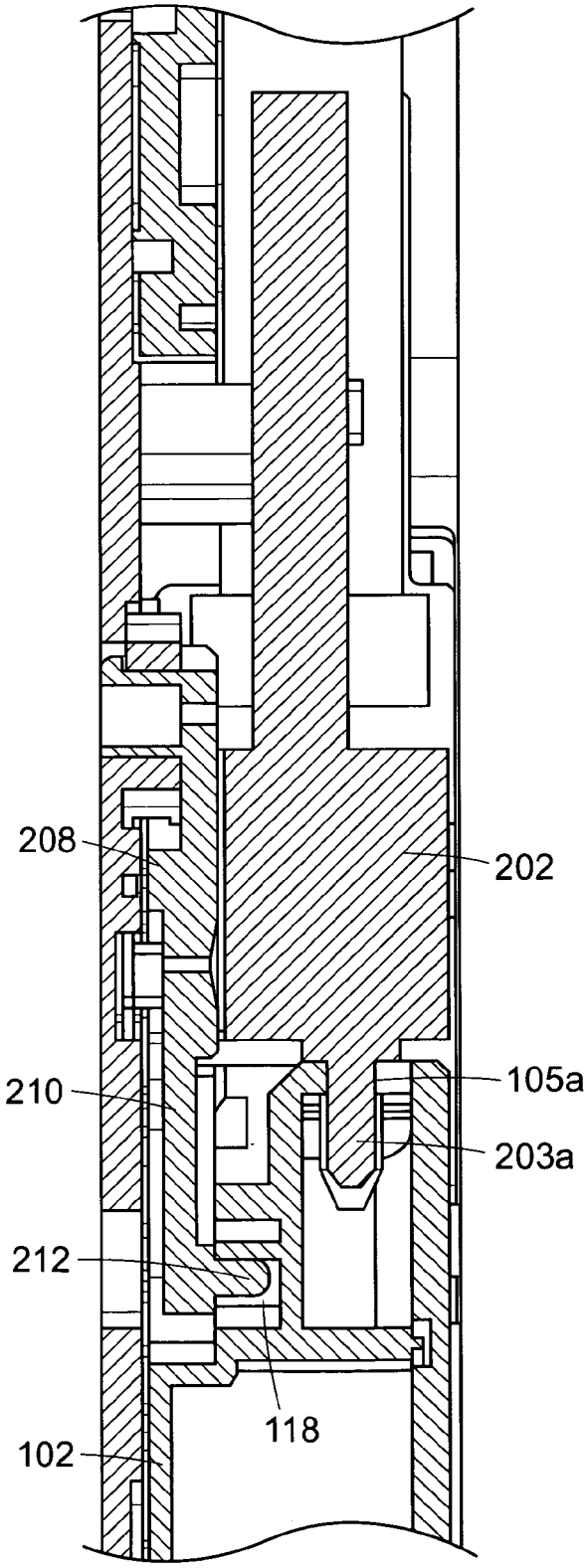
Figure 24A:
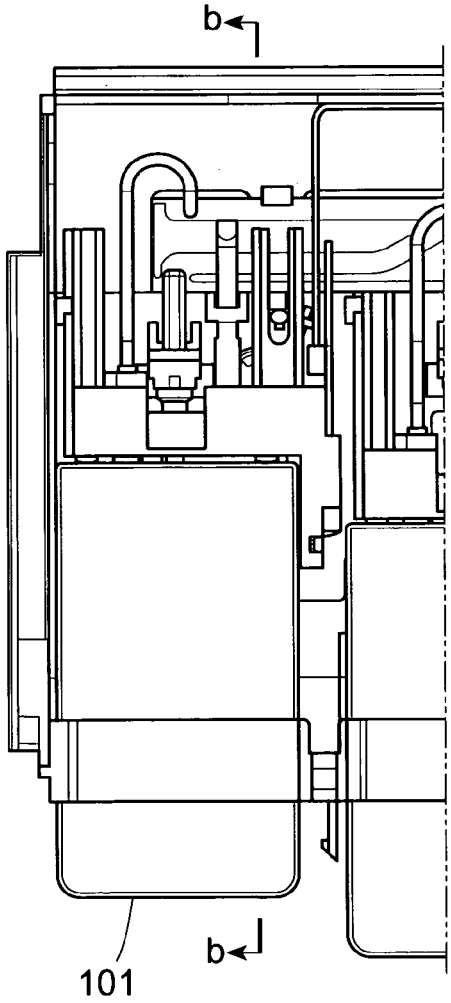

FIG. 24A is a top plan view showing the state where the ink cartridge according to the embodiment of the invention is mounted to the cartridge mounting part of the ink jet type recording apparatus so as to show the apparatus inside, and FIG. 24B is a side cross-sectional view taken along a line b-b in FIG. 24A.

Figure 25:
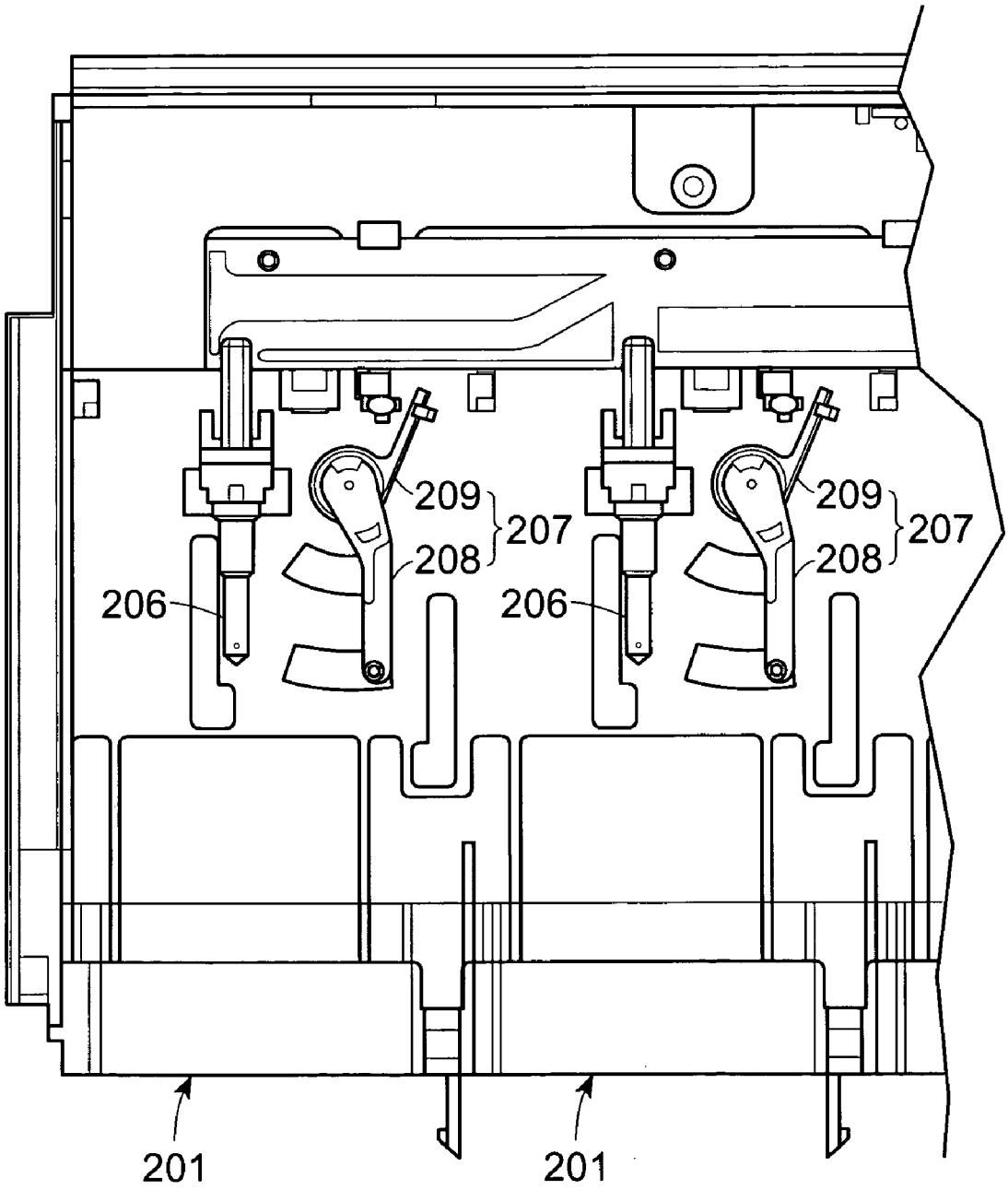

FIG. 25 is a top plan view showing the cartridge mounting part of the ink jet type recording apparatus shown in FIG. 20 in a state where a slider is removed so as to show the apparatus inside.

Figure 26:
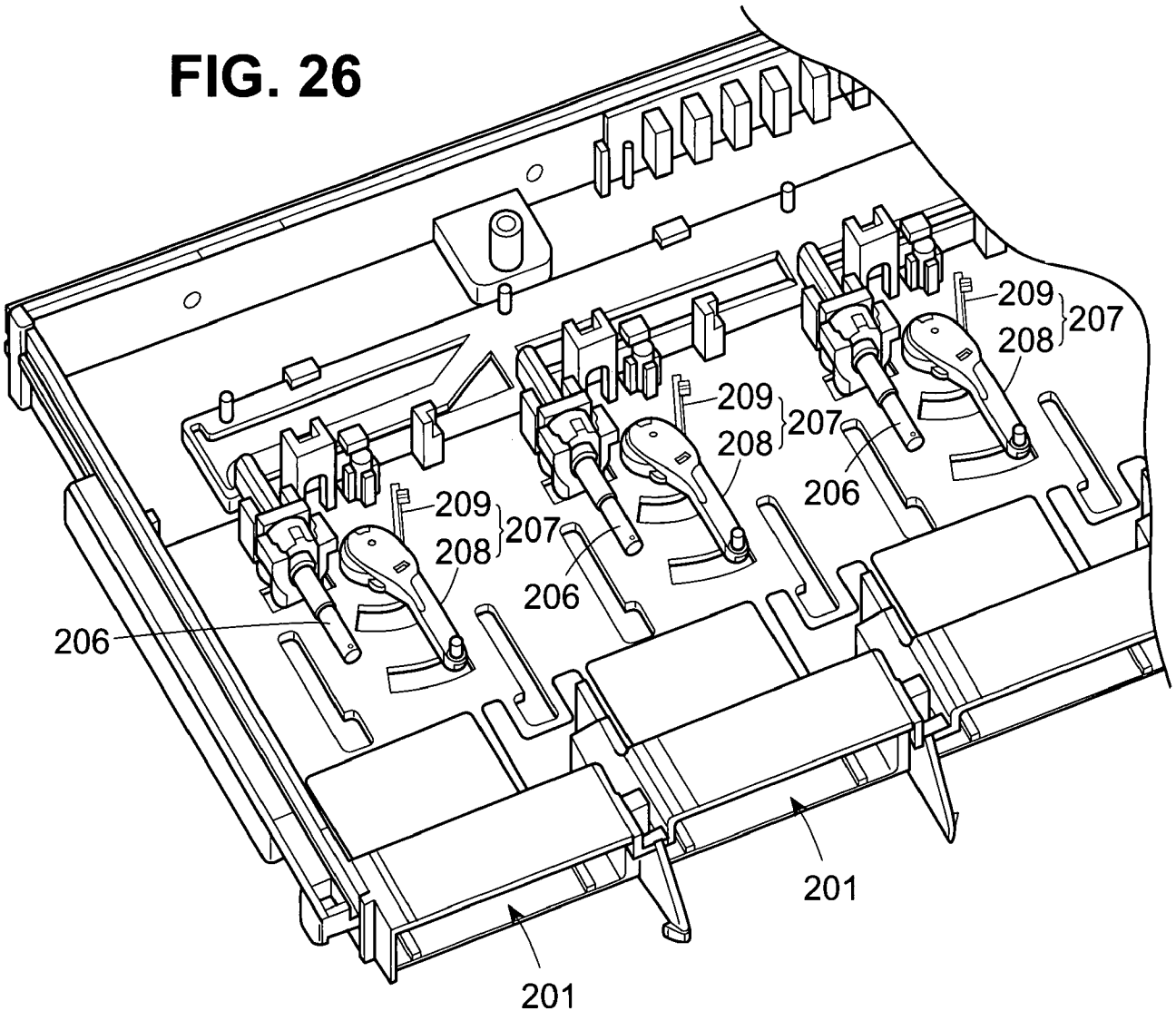

FIG. 26 is a perspective view showing the cartridge mounting part of the ink jet type recording apparatus shown in FIG. 21 in the state where the slider is removed so as to show the apparatus inside.

Figure 27A:
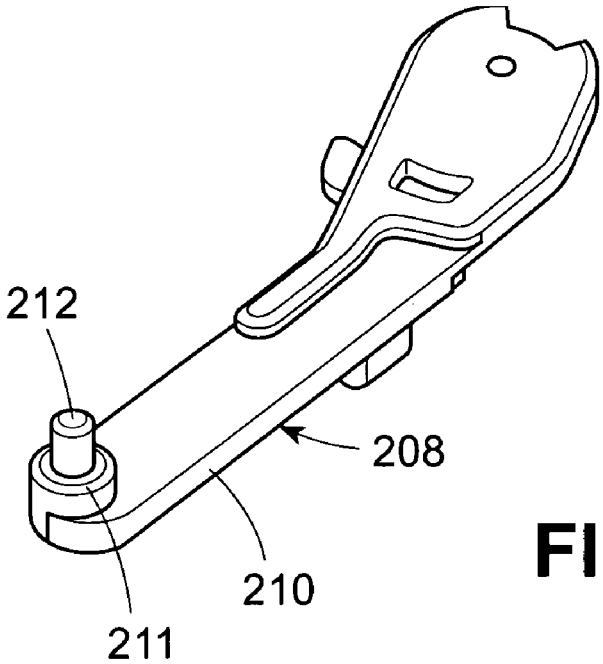
Figure 27B:
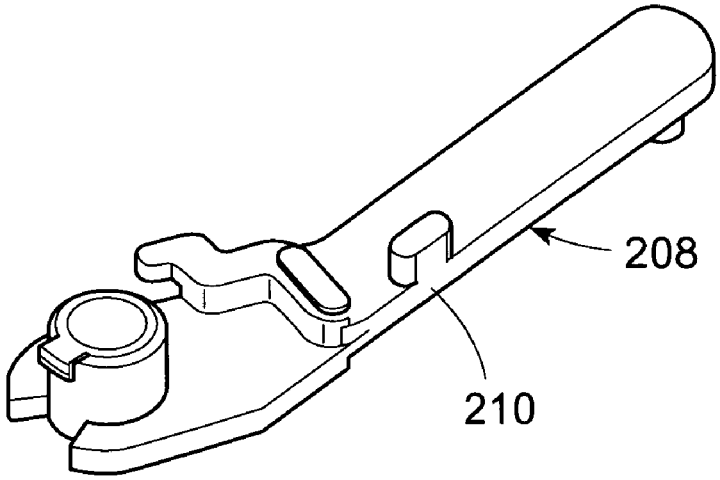

FIGS. 27A and 27B are enlarged perspective views of a turn lever member of the cartridge mounting part shown in FIGS. 25 and 26, in which FIG. 27A is a diagram viewed from a diagonal upside, and FIG. 27B is a diagram viewed from a diagonal downside.

Figure 28A:
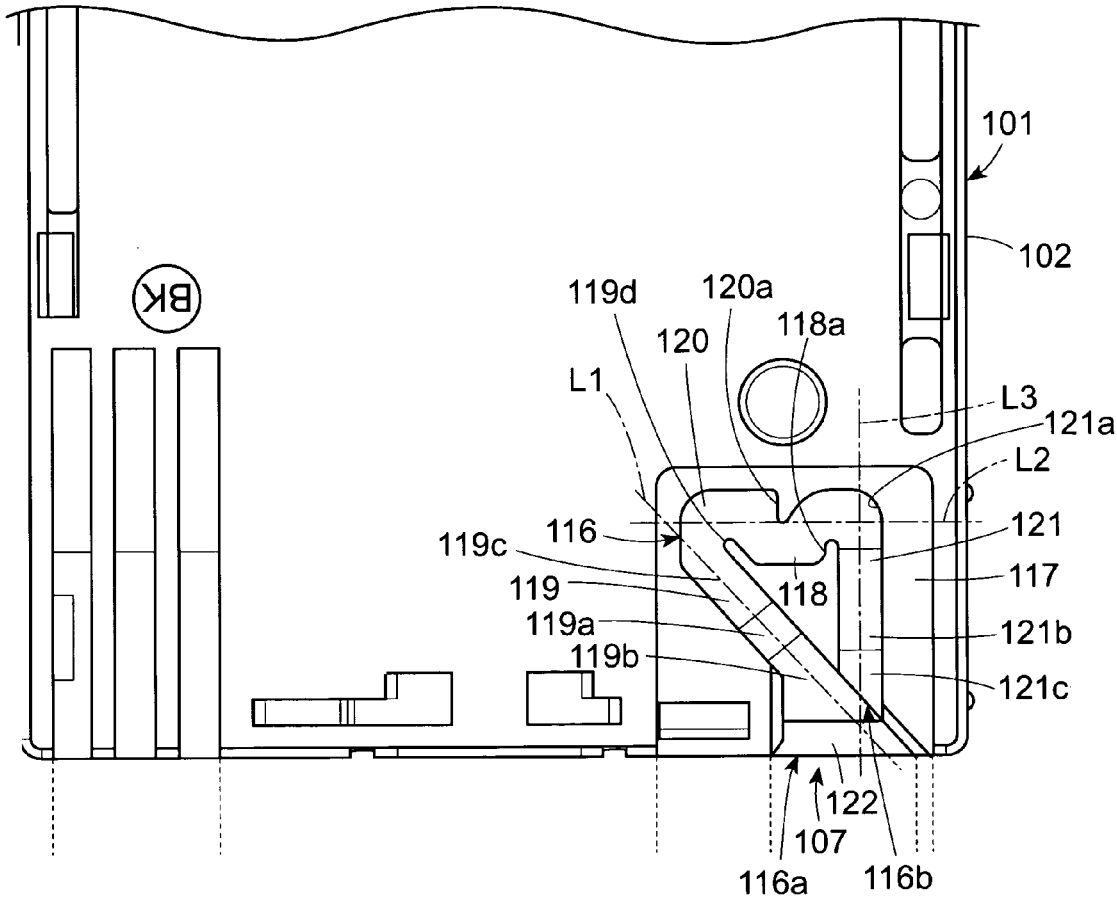
Figure 28B:
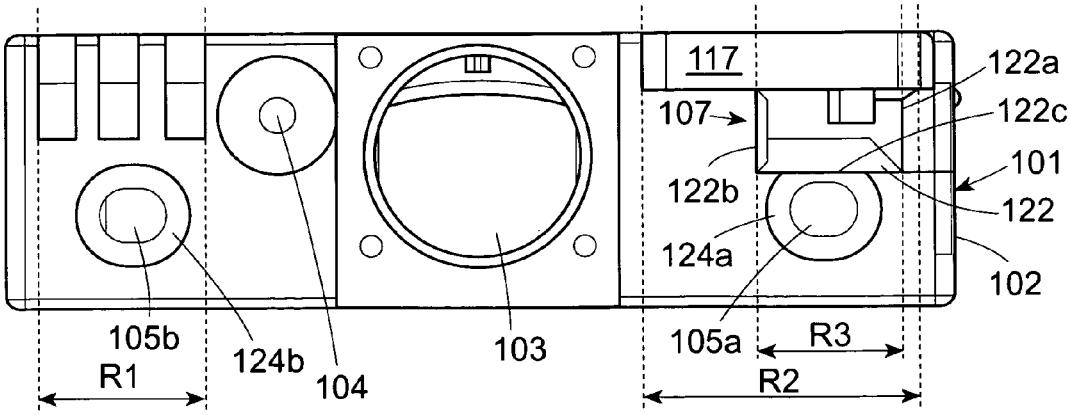

FIGS. 28A and 28B are enlarged views of the ink cartridge according to the embodiment of the invention, in which FIG. 28A is a bottom plan view showing a rear surface of a front-end part, and FIG. 28B is a front elevational view showing a front surface.

Figure 29A:
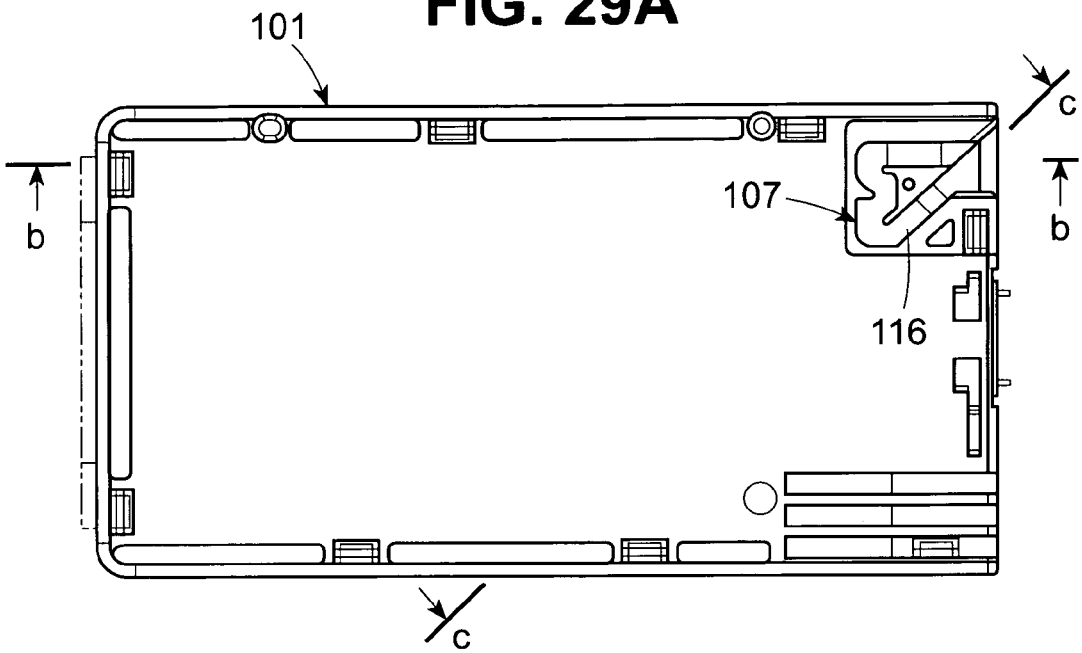
Figure 29B:
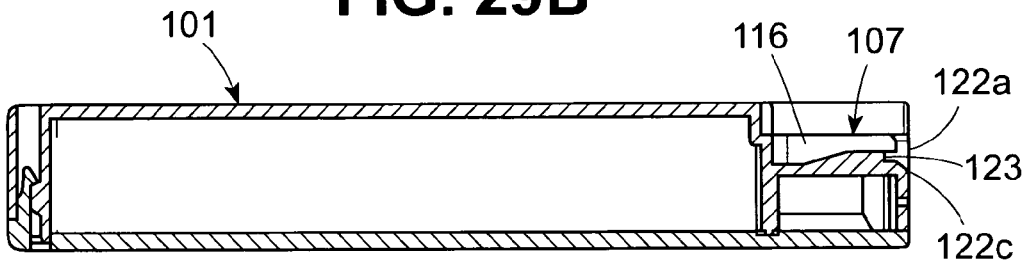
Figure 29C:
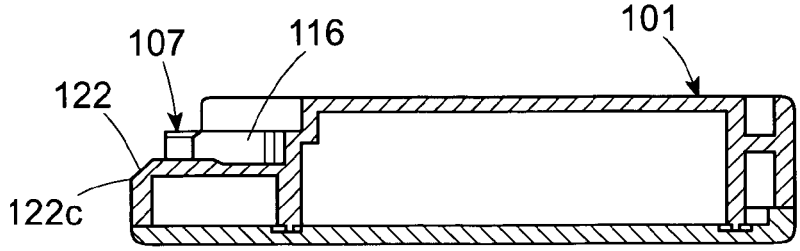

FIGS. 29A to 29C are diagrams illustrating the depth and shape of a guide groove of the ink cartridge according to the embodiment of the invention, in which FIG. 29A is a bottom plan view of the ink cartridge, FIG. 29B is a cross-sectional view taken along a line b-b in FIG. 29A, and FIG. 29C is a cross-sectional view taken along a line c-c in FIG. 29A.

Figure 30:
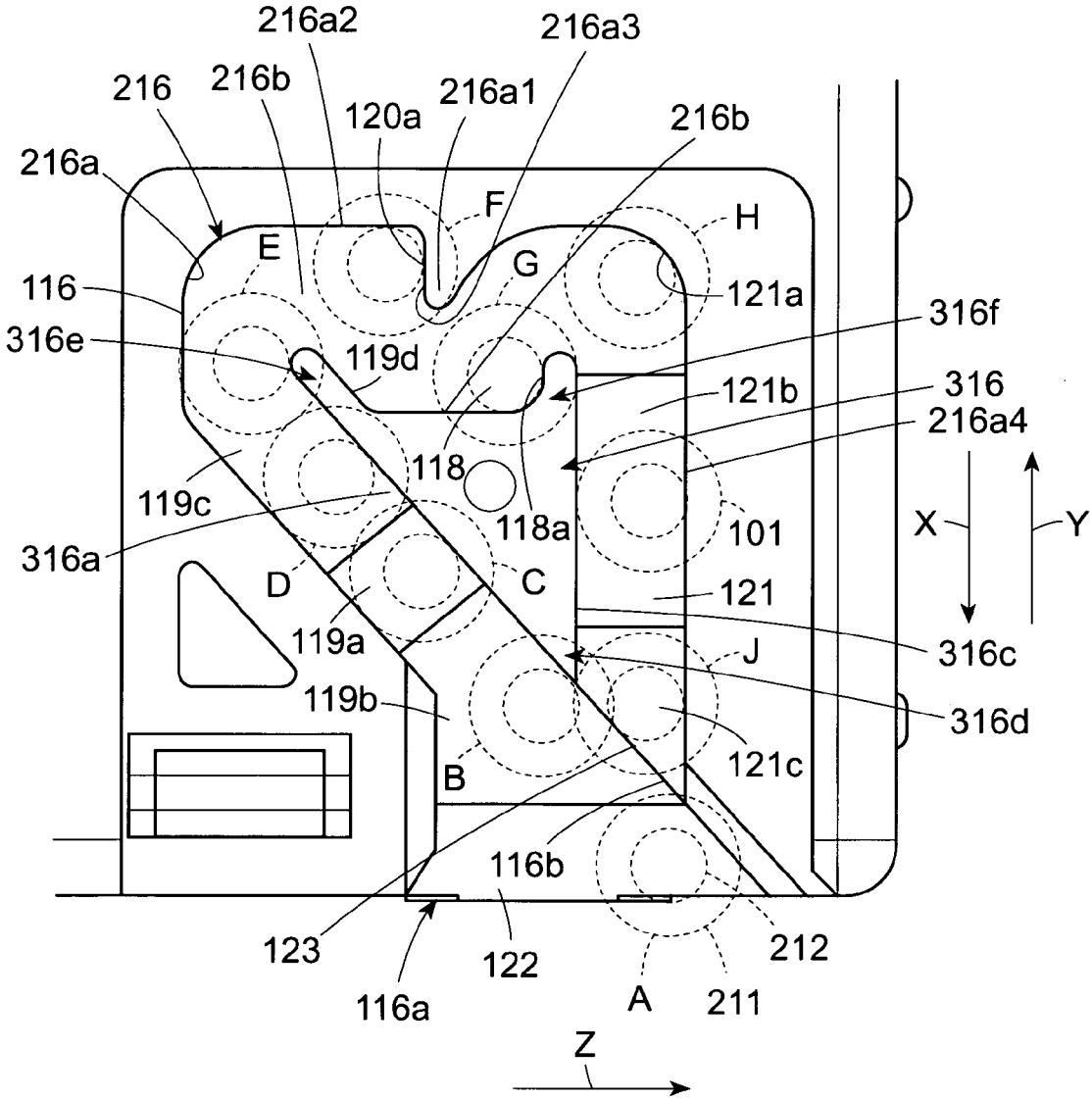

FIG. 30 is a diagram showing the motion of a fixing pin along a guide groove when the ink cartridge according to the embodiment of the invention is mounted and removed.

DETAILED DESCRIPTION OF THE INVENTION

The present invention is hereinafter described in detail with reference to the illustrated embodiments.

Figure 1:
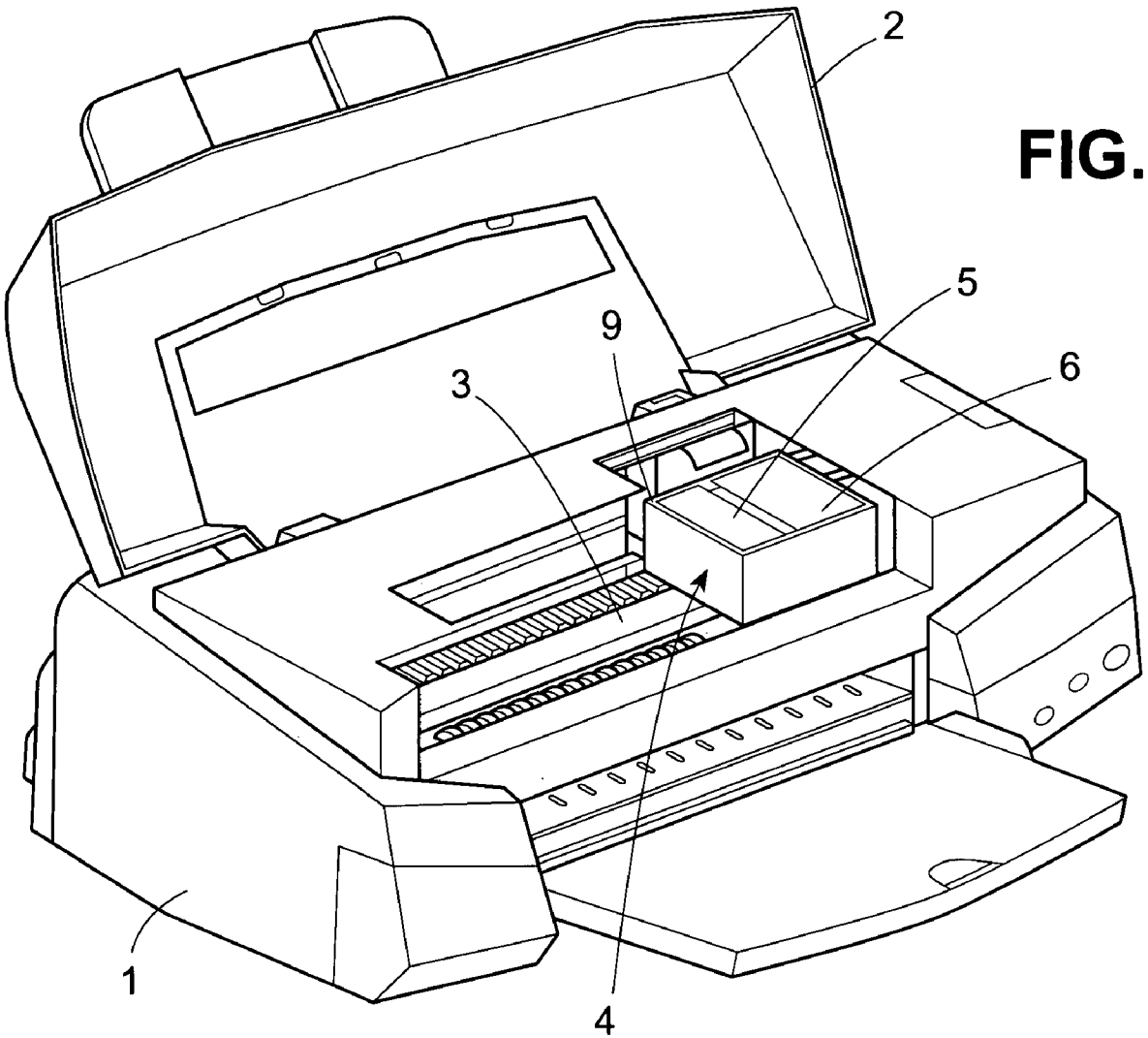
FIG. 1 is a perspective view showing an embodiment of an inkjet recording apparatus of the present invention.

FIG. 1 shows an embodiment of an inkjet recording apparatus of the present invention. A case is made up of a case body 1 and a cover 2. A carriage 4 is accommodated in the case to be opposed to a platen 3 and to be reciprocatingly movable. Two kinds of ink cartridges 5 and 6 having different widths are detachably mounted on the top surface of the carriage 4.

Figure 2:
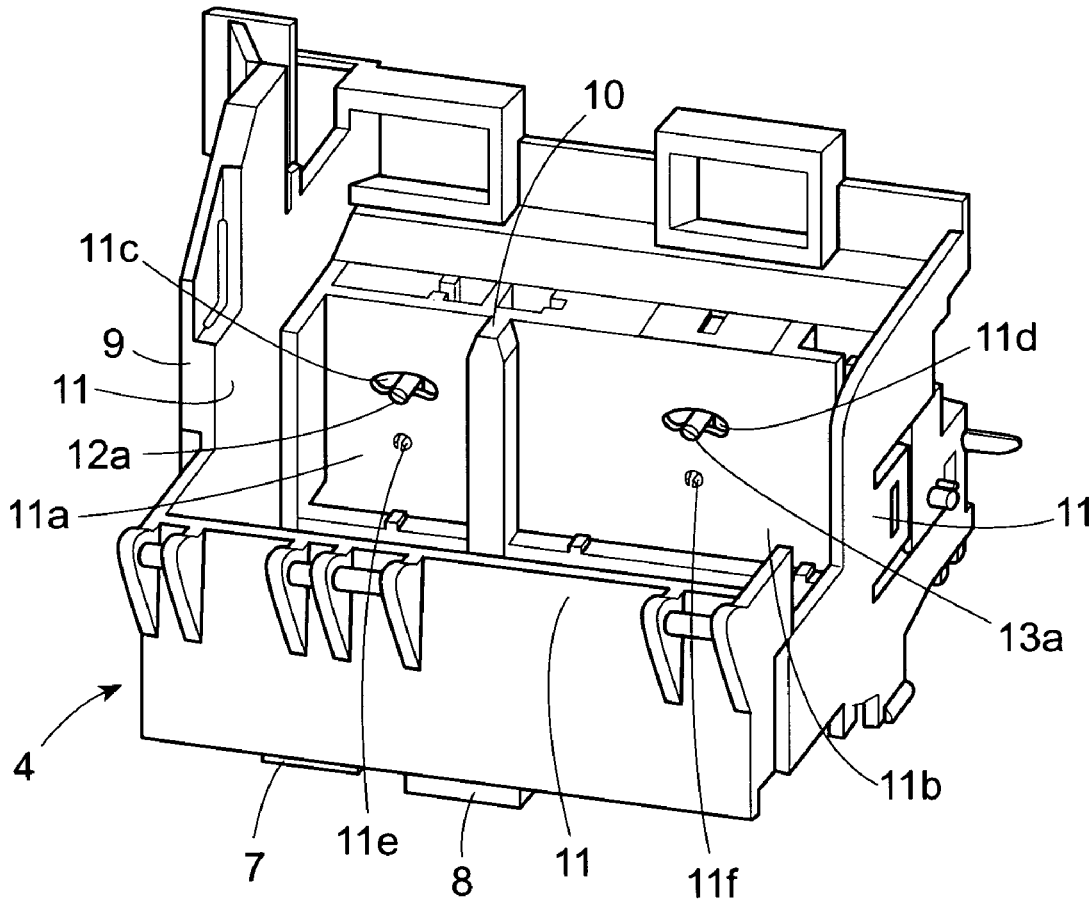
FIG. 2 is a perspective view showing the structure of a cartridge accommodation holder of a carriage which is a component of the inkjet recording apparatus of the invention.

FIG. 2 shows an embodiment of the carriage 4. In this embodiment, inkjet recording heads 7 and 8 that receive supply of inks from ink cartridges 5 and 6, respectively, are disposed on the bottom surface of the carriage 4. Vertical walls 11 form a boxlike enclosure on the upper surface of the carriage 4 to accommodate the ink cartridges 5 and 6 such that their top surfaces are exposed. In this way, a cartridge holder 9 is integrally formed.

The cartridge holder 9 is partitioned by a rib 10 into two sections to accommodate the two kinds of ink cartridges 5 and 6 in given regions. Windows 11*c* and 11*d* for forming fixing members are respectively formed at substantially central portions of the vertical walls 11*a* and 11*b* that respectively define the regions for accommodating the cartridges. Fixing protrusions 12*a* and 13*a* of fixing members 12 and 13 as described later protrude through the windows 11*c* and 11*d* into the side of the cartridge accommodation regions.

The windows 11*c* and 11*d* are formed as arc-shaped through holes which limit the movement of the fixing protrusions 12*a* and 13*a* to a certain angular range L. Mounting holes 11*e* and 11*f* are formed on the centerlines of the windows 11*c* and 11*d* and under these windows 11*c* and 11*d*.

These window 11*c*, 11*d* and fixing member 12, 13 together form a one-push type fixing member.

Figure 3A:
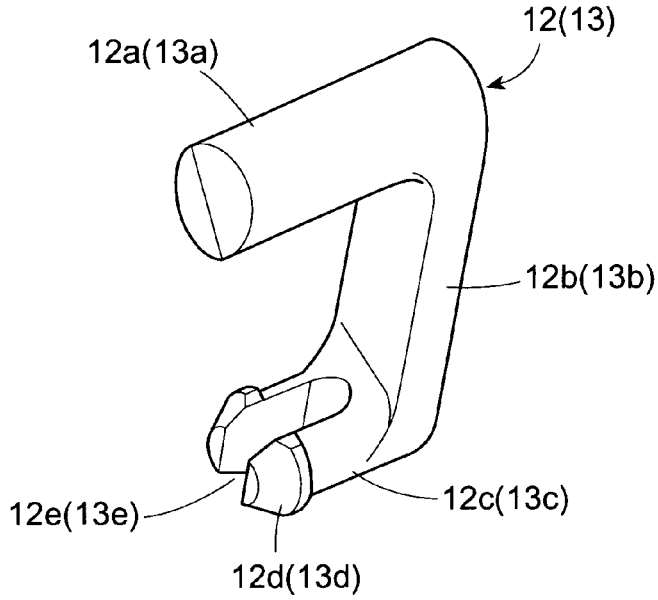
FIG. 3A is a perspective view showing an embodiment of a fixing protrusion.
Figure 3B:
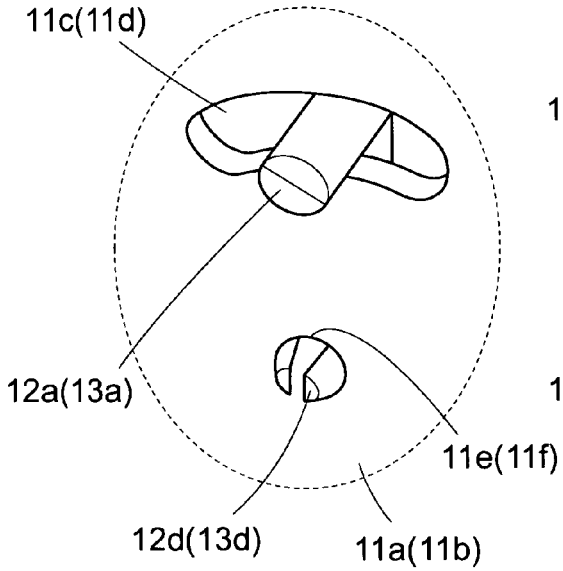
FIG. 3B is a perspective view showing a mounting state of the fixing protrusion at a front side on a vertical wall in the holder.
Figure 3C:
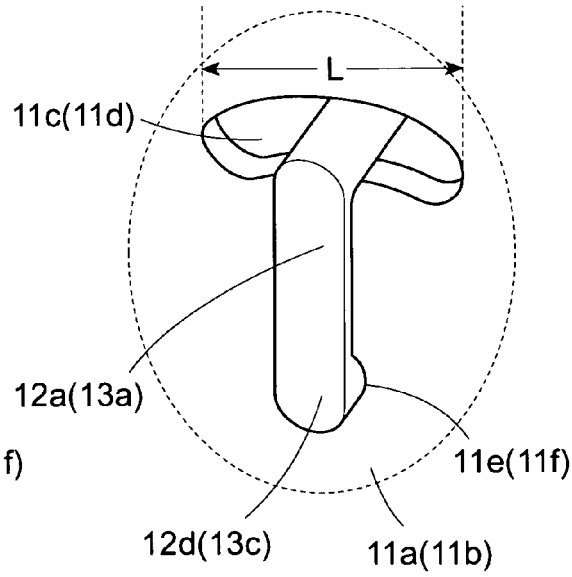
FIG. 3C is a perspective view showing the mounting state of the fixing protrusion at a rear side on the vertical wall in the holder.

FIG. 3A shows an embodiment of the fixing member 12, 13. In this embodiment, the fixing members 12 and 13 are shaped identically. The fixing members 12 (13) has an arm 12*b* (13*b*). The fixing protrusion 12*a* (13*a*) that is longer than the thickness of the vertical wall 11*a* (11*b*) but does not hinder insertion of the cartridge is formed at one end of the arm 12*b* (13*b*) perpendicularly to the longitudinal direction of the arm 12*b* (13*b*). A mounting portion 12*c* (13*c*) that is rotatably inserted into the mounting hole 11*e* (11*f*) is formed at the other end in the same direction as the fixing protrusion 12*a* (13*a*). A tapering portion 12*d* (13*d*) for preventing disconnection and a split groove 12*e* (13*e*) are formed at the front end of the mounting portion 12*c* (13*c*). The arm 12*b* (13*b*) is so designed that the position of the fixing protrusion 12*a* (13*a*) is displaceable in a direction intersecting a surface direction of a fixing member 30 described later in, conformity with recessed and protruded portions of the fixing member 30, and that the arm 12*b* (13*b*) has such an elasticity as to cause the fixing protrusion 12*a* (13*a*) to contact the fixing member 30 with a given contact force. This ensures reliable contact between the fixing protrusion 12*a* (13*a*) and the fixing member 30, to thereby eliminate failure of fixing the ink cartridge caused due to insufficient contact.

Because of this structure, when the fixing protrusion 12*a* (13*a*) of the fixing member 12 (13) is inserted into the window 11*c* (11*d*) and the tapering portion 12*d* (13*d*) of the mounting portion 12*c* (13*c*) is forced into the mounting hole 11*e* (11*f*), the mounting portion is permitted by the split groove 12*e* (13*e*) to be deformed and then rotatably fitted in the mounting hole 11*e* (11*f*).

Figure 4A:
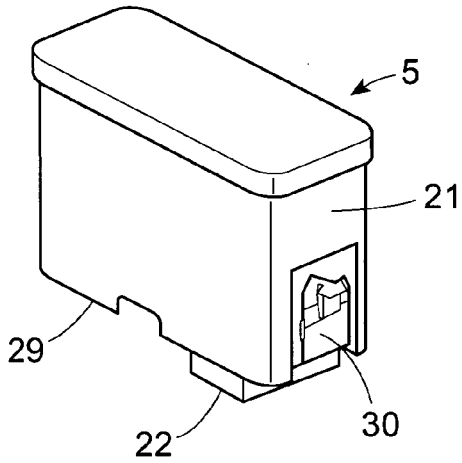
FIG. 4 is a perspective view of an embodiment of an ink cartridge adapted for the recording apparatus.
Figure 4B:
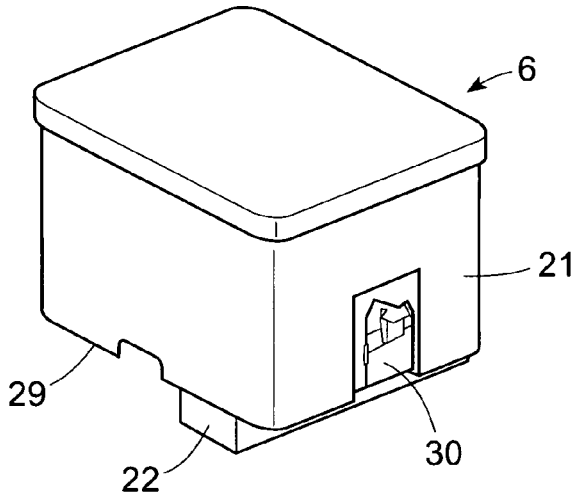

FIGS. 4A and 4B show embodiments of the ink cartridges 5 and 6 of the invention. Namely, FIG. 4A show the ink cartridge which contains one kind of ink, black ink in this embodiment, and FIG. 4B shows the ink cartridge which is formed with a plurality of separate ink storage chambers by partition walls or the like and which contains different kinds of inks, yellow, magenta and cyan in this embodiment, in respective ink storage chambers, each having an independent ink supply port.

Here, only one ink cartridge 5 is described. A fixing member 30 that guides and engages the aforementioned fixing protrusion 12*a* is formed in one wall surface 21 parallel to the direction of insertion of a container 20 that contains ink therein.

Another wall surface 29 that is perpendicular to the direction of insertion is provided with an ink supply port 22 that engages an ink supply needle 14 of the carriage to discharge the ink inside the cartridge therefrom.

In this ink cartridge, the fixing member 30 is disposed at a position offset toward the surface (the bottom surface) 29 where the ink supply port 22 is formed, i.e. at a lower portion region in the insertion direction of the ink cartridge in this embodiment, and further the ink supply port 22 is disposed at a position offset toward the wall surface (the side surface) 21 (i.e. at the right side in the figure). Consequently, the fixing member 30 can surely fix a portion of the ink cartridge in the vicinity of the ink supply port 22. This arrangement can prevent the displacement of the ink cartridge even when an external force is applied in a state in which the ink supply needle 14 is inserted into the ink supply port 22, to thereby reduce an adverse affect on the connection portion between the ink supply port 22 and the ink supply needle 14. That is, since the ink supply port 22 is located at the position offset toward the wall surface 21 where the fixing member is formed, the fixing member 30 can receive the external force to reliably provide the above-noted advantageous effect.

Figure 5:
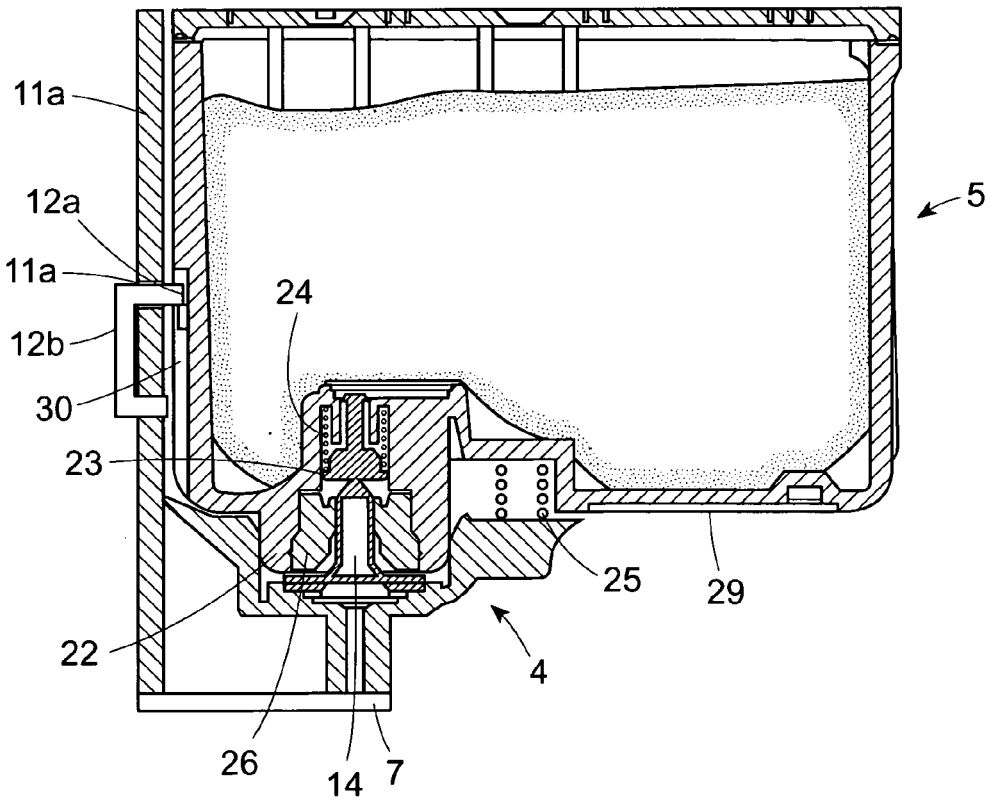
FIG. 5 is a cross-sectional view of the ink cartridge, taken through the ink supply port, and in which the cartridge is mounted the carriage.

As shown in FIG. 5, a packing 26 and a valve body 23 are loaded in the ink supply port 22 in such a way that the valve body 23 is biased by a spring 24 which is a coiled spring. The packing 26 serves as a sealing member, which closely and sealingly contacts the circumference of the ink supply needle 14. The valve body 23 contacts one end face of the packing 26 to close and seal an opening formed through the packing 26 when the cartridge is removed from the carriage, and opens the ink supply port by insertion of the ink supply needle 14 when the ink cartridge is mounted on the carriage. The extent of resilience of the spring 24 is such that even when the ink cartridge 5 is fully filled with ink and the ink supply port 22 engages the ink supply needle 14, the spring can bias the cartridge 5 in the direction opposite to the direction of insertion against the frictional force caused between the ink supply needle 14 and the packing 26.

In the aforementioned embodiment, the spring 24, provided in the ink supply port 17, for biasing the valve body 23 in the direction to close the valve body 23 is used to bias the ink cartridge in the direction opposite to the direction in which the cartridge 5 is inserted. In a case where the repulsion force of the spring 24 is small or the cartridge does not have the valve body 23 biased by the spring 24, the same advantages can be obtained by mounting a biasing spring 25 near the ink supply port 22 and in the front-end surface as viewed in the direction of insertion of the ink cartridge, (i.e., the surface in which the ink supply 22 is formed) or in the surface of the carriage 4 that faces the ink supply port 22.

Figure 6:
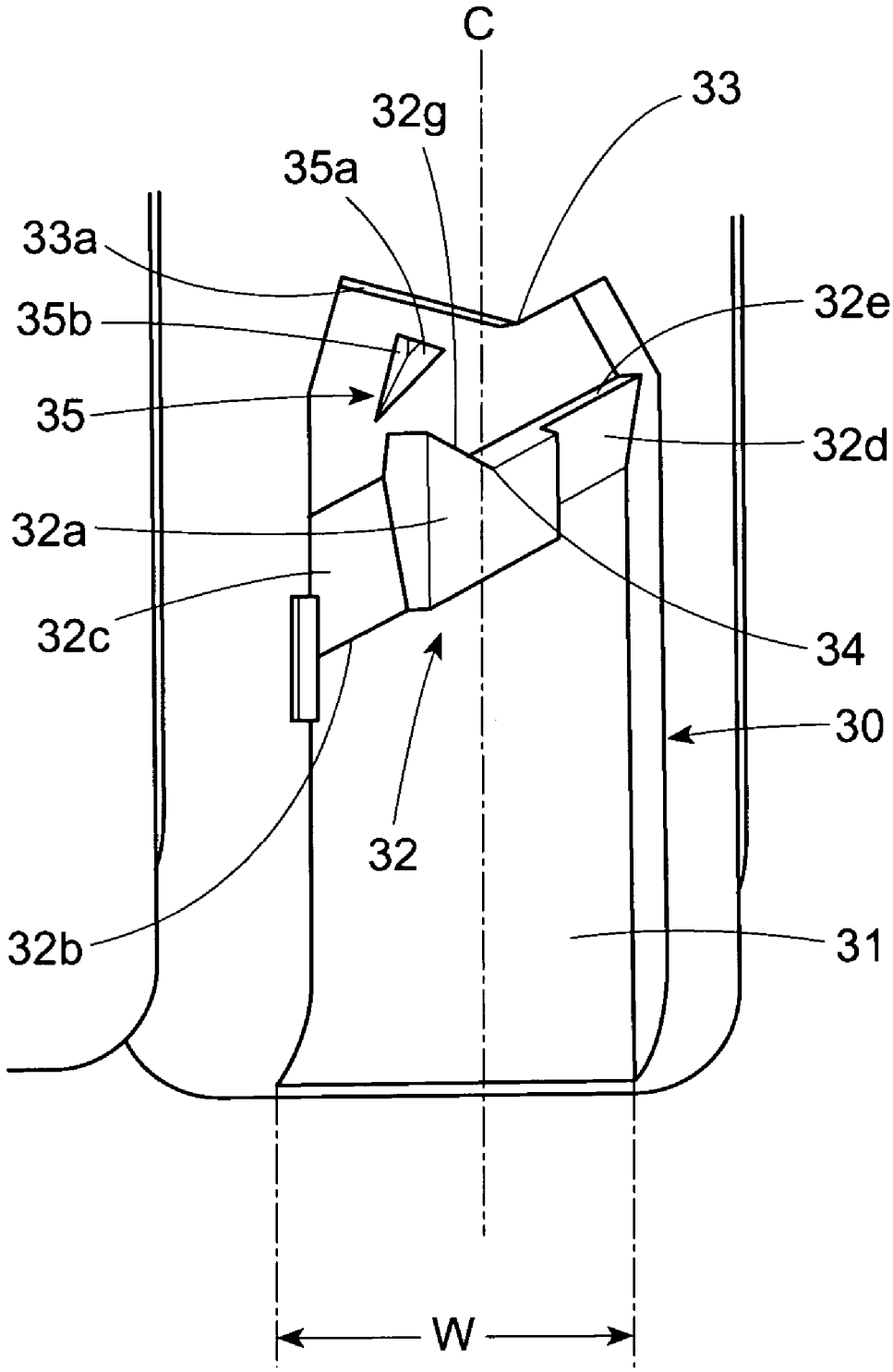
FIG. 6 is an enlarged perspective view of a fixing member formed in the ink cartridge.

FIG. 6 shows an embodiment of the fixing member 30 formed on the ink cartridge, which constitutes the one-push type fixing member. A recess portion 31 having an entrance port of, width W capable of almost covering the range of movement L of the fixing protrusion 12*a* is formed at the front end as viewed in the direction in which the cartridge is loaded (in this embodiment, in a lower portion). A guide portion 32 having an upper portion on one side is formed in the center of the recess portion 31 as viewed in the direction of insertion of the cartridge. A protruded portion 32*a* is formed in the center of the guide portion 32 such that passages through which the protrusion 12*a* can pass are formed on both sides of the protruded portion 32*a*.

In a lower portion side (the left side in the figure) relative to the protruded portion 32*a*, there are formed a vertical wall 32*b* over which the protrusion 12*a* cannot pass during the movement of the ink cartridge in the insertion direction, and an inclined surface 32*c*, above the vertical wall 32*b*, over which the protrusion 12*a* can easily pass during the movement of the ink cartridge in the removal direction.

In the other side, i.e. an upper portion side (the right side in the figure) relative to the protruded portion 32*a*, there are formed an inclined surface 32*d* over which the protrusion, 12*a* can easily pass during the movement of the ink cartridge in the insertion direction, and a vertical wall 32*e*, above the inclined surface 32*d*, over which the protrusion 12*a* cannot pass during the movement of the ink cartridge in the removal direction. This arrangement of the inclined surface 32*d* and the vertical wall 32*e* in the upper portion side is reverse to the arrangement of the vertical wall 32*b* and the inclined surface 32*c* in the lower portion side. The protrusion 12*a* enters through the inclined surface 32*d*, and exits through the inclined surface 32*c*.

An angular vertical wall 33*a*, whose vertex 33 is located slightly offset from the centerline C of the recess portion 31 toward the inclined surface 32*d*, is formed in a deeper portion of the recess portion 31 relative to the entrance side of the protrusion 12*a*. A vertical wall 32*g* obliquely upwardly extends substantially from the centerline C of the protruded portion 32*a* toward the exist side (the left side in the figure) to provide a holding portion 34 made up of a V-shaped recess portion for engagement with the protrusion 12*a*.

This holding portion 34 is disposed at a center in the width direction of the cartridge, or on a plane which passes through a central axis of the ink supply port and which is perpendicular to the wall surface, so that the holding portion 34 in cooperation with the protrusion 12*a* can reliably fix the ink cartridge 5 at a predetermined position, while causing no moment on the ink supply needle 14.

Indicated by numeral 35 in the figure is a movement direction-restricting member disposed closer to the inclined surface 32*c* than to the holding portion 34. This restricting member 35 has an inclined surface 35*a* over which the protrusion 12*a* can easily pass and a vertical wall 35*b* over which the protrusion 12*a* cannot easily pass.

Figure 7I:
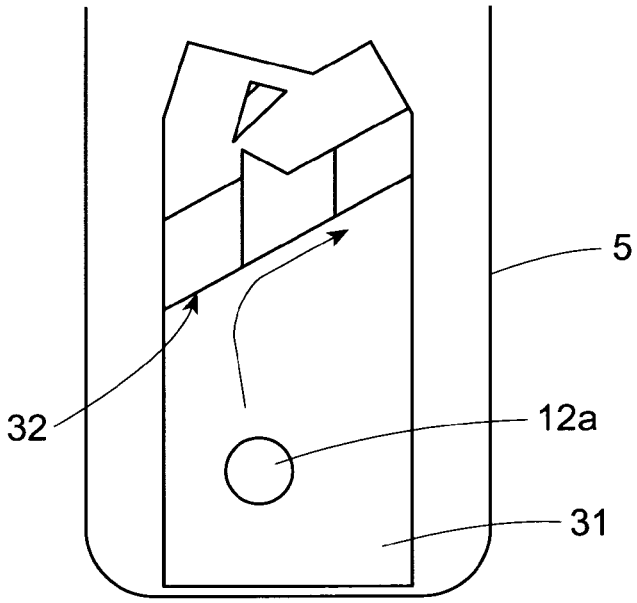
FIGS. 7I and 7II are views illustrating the former half of steps performed when the ink cartridge is mounted.
Figure 7:
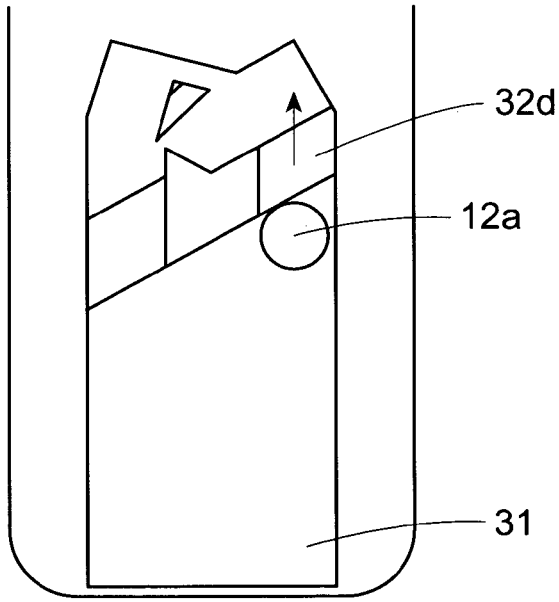

In this embodiment, when the ink cartridge 5 is inserted, the fixing protrusion 12*a* enters the opening of the recess portion 31 of the fixing member 30 and reaches the inclined surface 32*d* while being guided by the guide portion 32 (the vertical wall 32*b*) in one direction (FIG. 7I). Then, the fixing protrusion 12*a* passes over this inclined surface 32*d* (FIG. 7I).

Figure 8I:
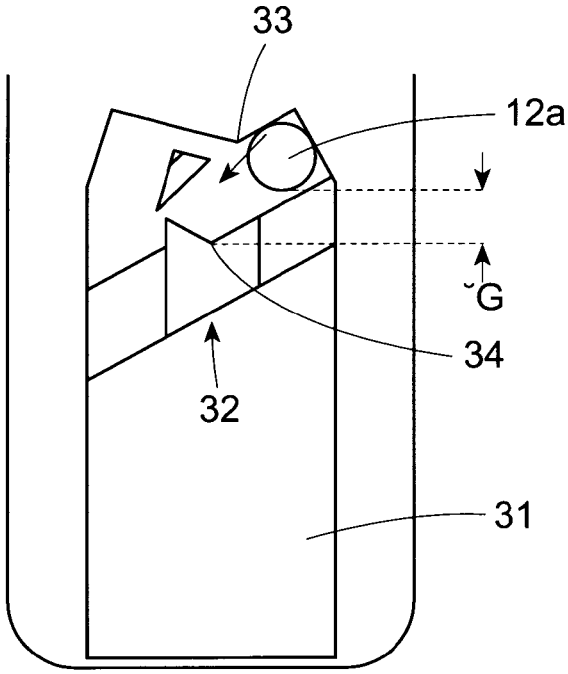
FIGS. 8I and 8II are views illustrating the latter half of the steps performed when the ink cartridge is mounted.
Figure 8:
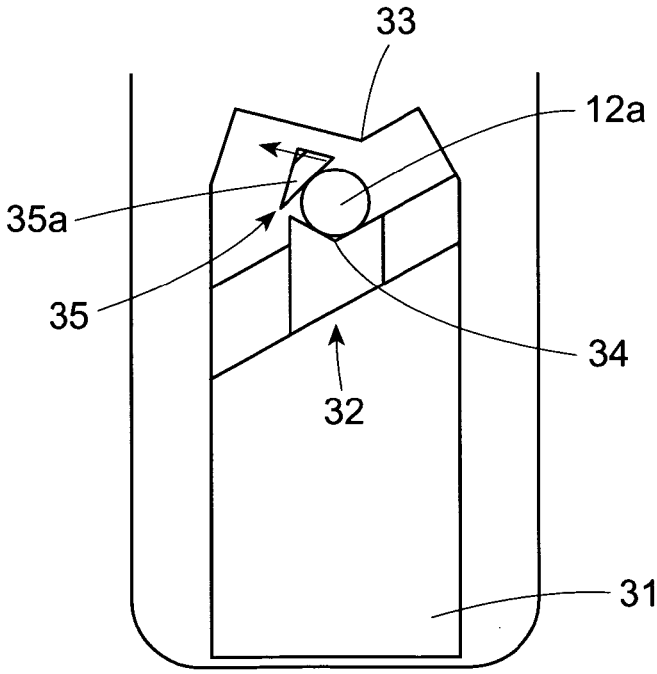

Under this condition, when the cartridge 5 is further pushed-in against the elastic force of the spring 24 of the ink supply port, the ink cartridge 5 reaches a dead point at which the fixing protrusion 12*a* contacts the angular wall 33*a* located in the deeper portion of the recess portion 31 (FIG. 8I). Under this condition, if the hand is released from the ink cartridge 5, the ink cartridge 5 is moved by a slight distance AG in the direction opposite to the direction of insertion by the reaction force of the spring 24 so that the fixing protrusion 12*a* is fitted into the holding portion 34, while being guided toward the centerline C by the vertical wall 32*e* (FIG. 8II).

There is a slight clearance between the dead point at the pushing-in of the ink cartridge 5 into the cartridge holder and a cartridge holding position. For this reason, when the ink cartridge is moved from the dead point at the pushing in to the cartridge holding position, the packing 26 is moved in the contracting direction due to the friction to the ink supply needle 14, so that the packing 26 reliably contacts the circumference of the ink supply needle 14 elastically, to thereby ensure air-tightness.

In addition, such clearance can be determined by the diameter of the fixing protrusion 12*a*, the position of the holding portion 34, or the like.

Figure 9I:
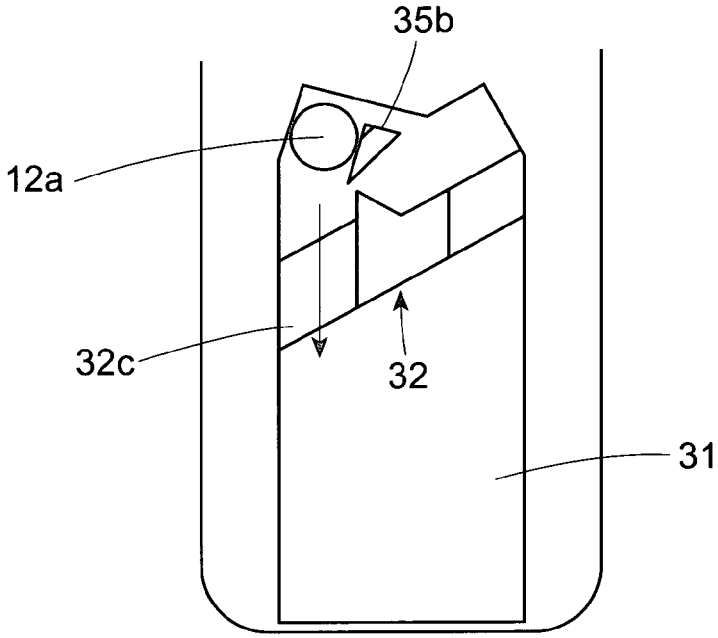
FIGS. 9I and 9II are views illustrating steps for taking out the ink cartridge.
Figure 9:
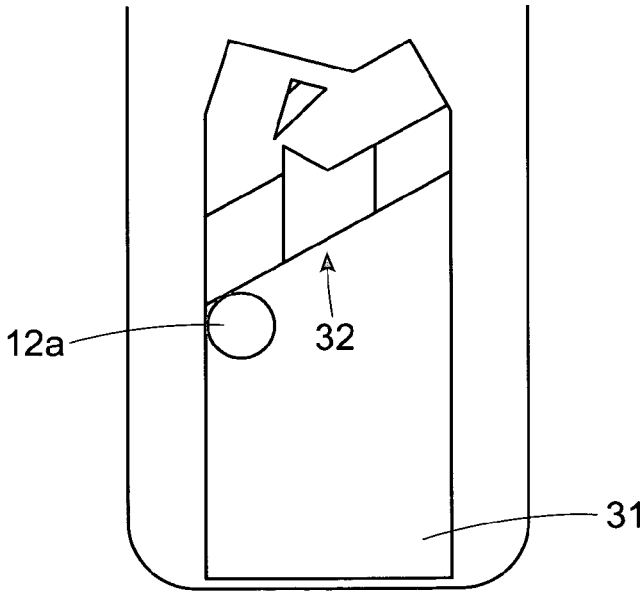
Figure 10:
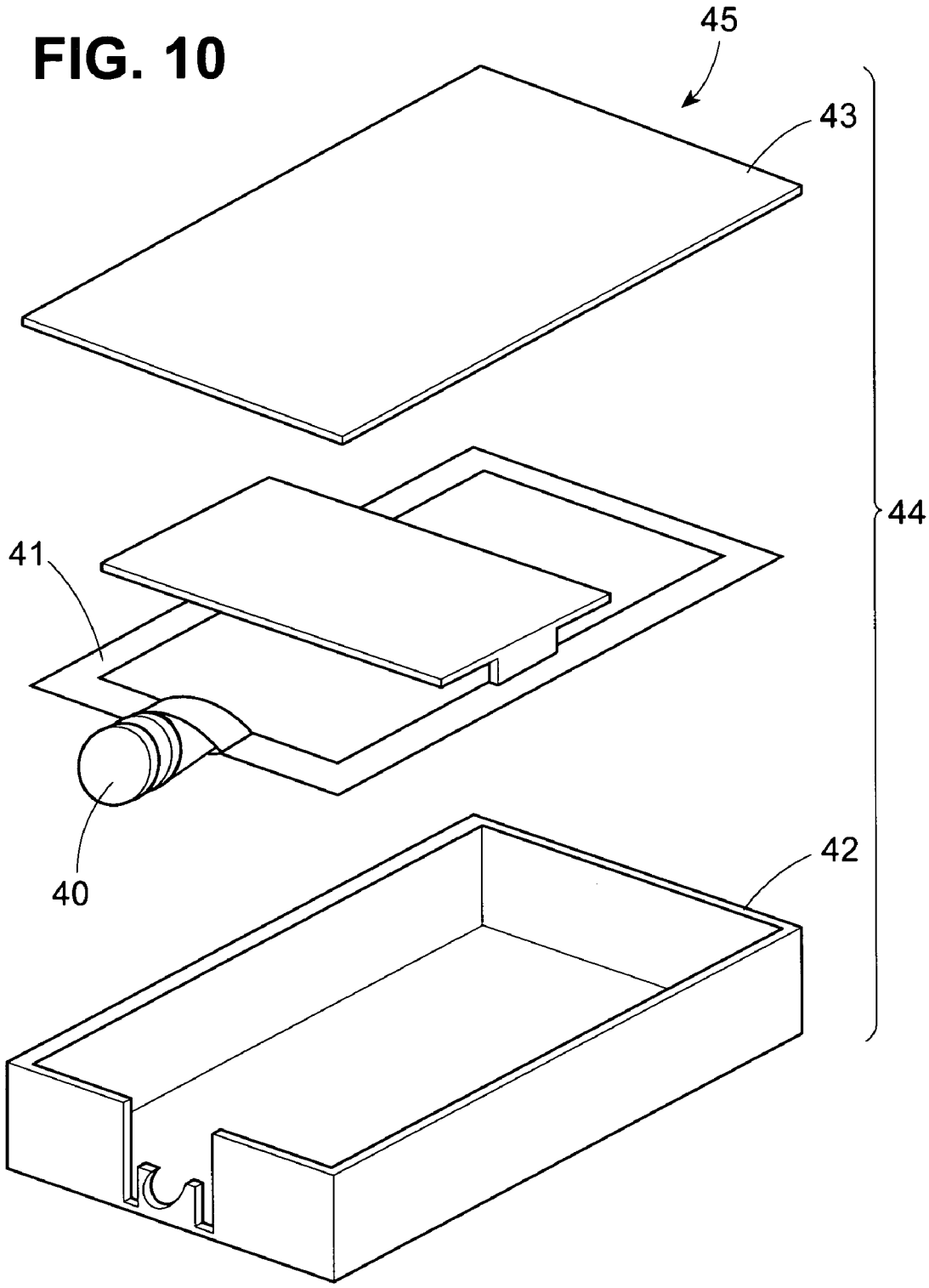
FIG. 10 is an exploded perspective view showing another embodiment of the ink cartridge to which the invention can be applied.
Figure 11:
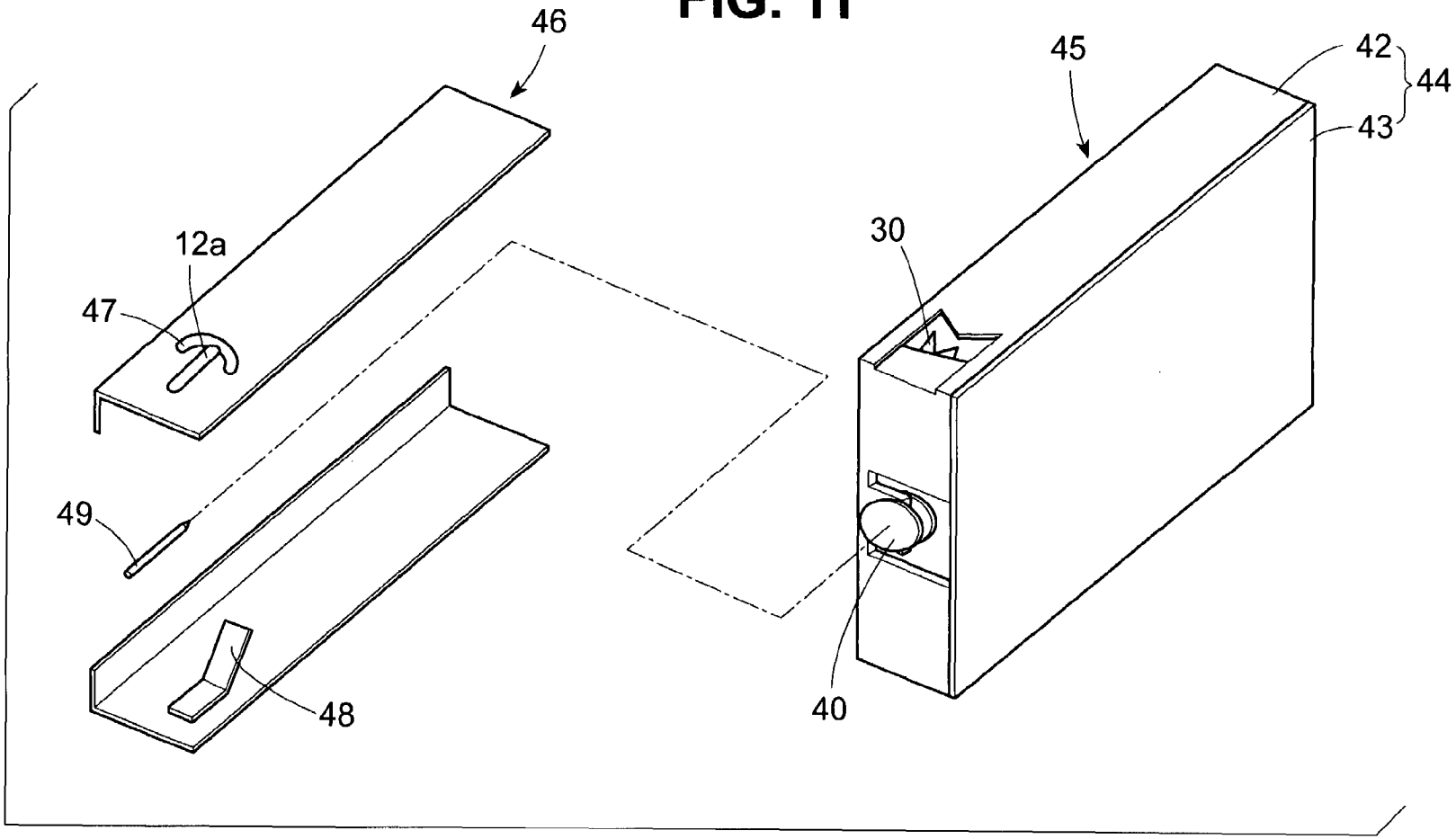
FIG. 11 is a view showing an embodiment of a cartridge holder adapted for the ink cartridge.

On the other hand, in a case where the ink in the ink cartridge has been consumed and the ink cartridge 5 is replaced, the cartridge 5 is pushed-in against the reaction force of the spring 24. The fixing protrusion 12*a* passes over the inclined surface 35*a* of the movement-restricting member 35, while being guided by the angular wall 33*a* located in the deeper portion of the recess portion 31 (FIG. 9I). The amount of the movement during this pushing-in corresponds to the aforementioned slight clearance between the dead point at the pushing-in and the cartridge holding position. By this movement, the packing 26 is relatively moved with respect to the ink supply needle 14 so that ink flows in therebetween. The ink serves as lubricant to reduce the friction during the removal.

Under this condition, if the hand is released from the cartridge 5, the reaction force of the spring 24 elevates the cartridge 5. During this process, the fixing protrusion 12*a* passes over the inclined surface 32*c* to be free from the restriction (FIG. 9II)

When a new cartridge 5 is loaded into a given position and then pushed-in, the ink cartridge can be fixed into a predetermined position in the same way as the foregoing.

In the embodiment described above, a recording apparatus of the type where the cartridge holder is mounted to the carriage has been described. It is apparent that similar advantages can be produced when the invention is applied to a type of the recording apparatus in which the cartridge is installed on the case body 1 forming the recording apparatus and ink is supplied to the recording head by the use of an ink supply tube.

That is, in a case of an ink cartridge 45 in which a flexible bag 41 containing ink therein and having an ink supply port 40 on one side thereof is accommodated in a hard case 44 made up of a case body 42 and a cover 43 in such a way that the ink supply port 40 is exposed, the aforementioned one-push type fixing member 30 is formed on a side surface of the hard case 44 such that the front side as viewed in the direction of insertion becomes an opening portion.

On the other hand, the other one-push type fixing member is formed such that the fixing protrusion 12*a* is protruded from the rotational range limiting window 47 at the side of the ink cartridge accommodating holder 46 to be opposed to the fixing member 30. A resilient member 48 is disposed on the side of an ink supply needle 49. In this way, the cartridge 45 can be fixed into a predetermined position simply by pushing it in. When the ink cartridge 45 is removed, the ink cartridge 45 is pushed in against the resilient member 48. In this way, the ink cartridge 45 can be taken out.

This embodiment can also employ, in place of the resilient member 48, a valve arrangement having the valve body 23 installed in the ink supply port 22 and the spring 24 for biasing the valve body 23 toward the ink supply port side as discussed with reference to FIG. 5, in order to produce the same effect using the elastic of the spring for biasing the valve body.

Figure 12:
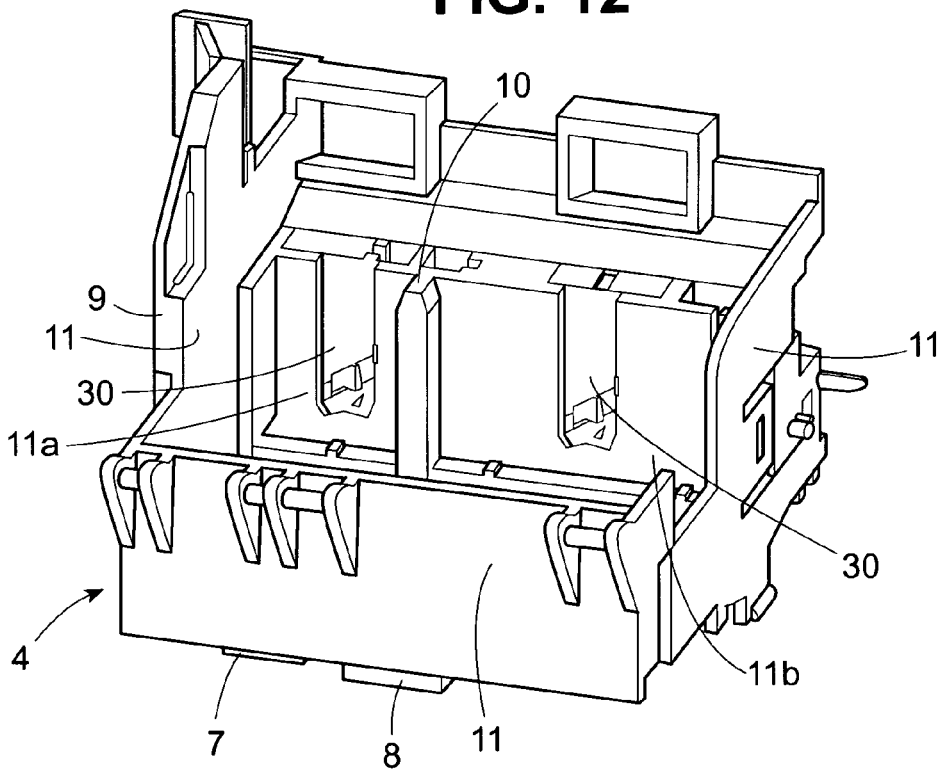
FIG. 12 is a perspective view in which another embodiment of the recording apparatus of the invention is shown by the structure of a cartridge accommodation region.
Figure 13A:
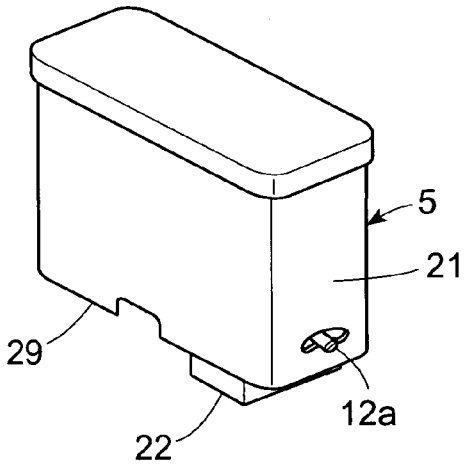
FIGS. 13A and 13B are perspective views, each showing another embodiment of the ink cartridge of the invention.
Figure 13B:
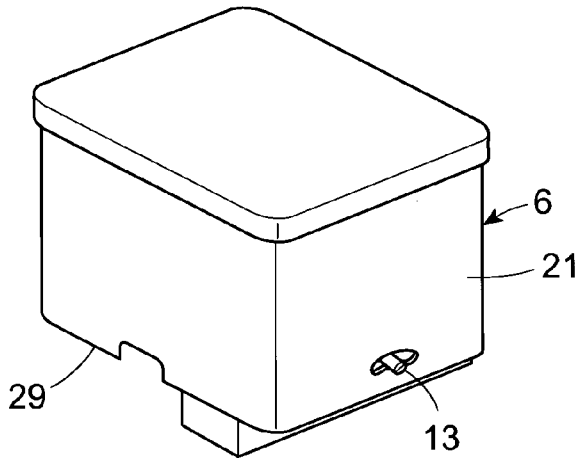

In the embodiment described above, a one-push type fixing member for receiving a fixing protrusion and another one-push type fixing member having the fixing protrusion are formed on the ink cartridge and cartridge holder, respectively. It is apparent that, the same advantages can be obtained when one push type fixing member 30 for receiving the fixing protrusion is arranged on the cartridge holder 9 and another one-push type fixing member having the fixing protrusion 12*a*, 13*a* is arranged on the ink cartridge 5, 6 as shown in FIGS. 12 and 13.

[Following is from 253]xxx

As an embodiment of a liquid container according to the invention, an ink cartridge for an ink jet type recording apparatus will be described with reference to drawings.

FIG. 14 is a perspective view showing several ink cartridges 101 according to the embodiment and a cartridge mounting part 201 of an ink jet type recording apparatus to which these ink cartridges 101 are mounted. In this example, six cartridge mounting parts 201 are provided for the ink jet type recording apparatus 200, and each cartridge mounting part 201 is opened on a front surface of the ink jet type recording apparatus 200. Further, the six cartridge mounting parts 201 are arranged adjacent to each other along a line on the same horizontal plane, and the six ink cartridges are arranged in a flat manner and adjacent to each other along a line.

FIGS. 15A-17D are diagrams respectively showing an exterior shape of one ink cartridge 101. The ink cartridge 101 has a container body 102 formed approximately in the shape of a rectangular parallelepiped, and an ink supply port 103 from which ink is fed out to the ink jet type recording apparatus 200 is formed at a front surface of this container body 102.

In other words, the ink cartridge's container body is generally rectangular, meaning it is a structure having walls at least part of which lie in X, Y and Z planes. The present invention therefore contemplates variant structures such as cartridge bodies where one or more corners are clipped off, or portions of the flat walls are curved or lie in other planes.

Likewise, the term "proximate to a corner" is used generally, and covers the positioning of a structure relative to a corner where some benefit is derived by virtue of the proximity of the structure to that corner.

Positional terms like "top" and "bottom" are relative, and depend upon the orientation of the ink cartridge. Thus, what is a top surface would become the bottom surface, upon inversion of the cartridge.

Further, the front surface of the container body 102 also includes a pressure fluid inlet 104 through which pressure fluid for pressurizing ink inside the container body 102 and feeding-out the ink from the ink supply port 103 is introduced into the container body 102.

Further, a pair of positioning holes 105*a* and 105*b* into which a pair of positioning projections provided at the cartridge mounting part 201 are inserted is formed on the front surface of the container body 102. Around the pair of positioning holes 105*a* and 105*b* are formed cartridge-side positioning surfaces 124*a* and 124*b*, which are brought into contact with apparatus-side positioning surfaces of the cartridge mounting part 201 so as to perform positioning in the inserting direction of the ink cartridge 101. The pair of positioning holes 105*a* and 105*b* and the pair of cartridge-side positioning surfaces 124*a* and 124*b* constitute a cartridge-side positioning part.

In this embodiment, openings of the ink supply port 103, pressure fluid inlet 104 and positioning holes 105*a*, 105*b* extend into the ink cartridge 101 along respective lines (axes) which are parallel to one another. Further, as shown in FIG. 15D, the openings of the positioning holes 105*a*, 105*b* and the central axes thereof lie in a plane P1 parallel to a bottom surface of the container body 102.

Further, an erroneous mount preventing structure 106 is provided at a corner of the container body 102 including the front surface, that is, at a corner on the opposite side to a cartridge-side fixing structure 107 side in relation to the ink supply port 103. This erroneous mount preventing structure 106 has such a shape as to properly mount a predetermined ink kind of ink cartridge 101 to a predetermined position when the ink cartridge 101 is attached to the ink jet type recording apparatus 200, and to prevent mounting of any cartridge that is not the proper ink type of ink cartridge.

By way of non-limiting example, the erroneous mount preventing structure 106 could have a number of grooves whose length, width and/or depth correspond to the color or type of ink which the ink cartridge contains. Yellow, magenta, cyan and black cartridges would all have different groove arrangements, thereby preventing mis-insertion of a cartridge in an incorrect printer receptacle.

In addition, if a user can surely identify the property of the ink cartridge and a proper mount position for the ink cartridge, the erroneous mount prevention structure 106 may be omitted. In this case, in place of the structure 106, a large recess having a simple rectangular parallelopipedal shape may be provided as illustrated by a dotted letter LR in FIGS. 15D and 16A, which large recess is shaped and dimensioned to accept reception of all identification projections disposed on the cartridge mounting part 201.

Further, on a rear surface (bottom surface) of the container body 102, at the corner on the opposite side to the corner where the erroneous mount preventing structure 106 is provided, the cartridge-side fixing structure 107 is provided adjacent to the front surface of the container body 102. This cartridge-side fixing structure 107, when the ink cartridge 101 is mounted to the container mounting part 201, regulates the movement of the ink cartridge 101 in the pulling direction so as to control insertion to and removal from the ink jet type recording apparatus.

Though the cartridge-side fixing structure 107 is provided on the rear surface of the container body 102 in this embodiment, the cartridge-side fixing structure 107 is not to be limited in position to the rear surface of the container body 102 but can be located elsewhere, for example, on the upper surface of the container body 102.

Further, as depicted in FIG. 16B, on one side surface of the container body 102, near the cartridge-side fixing structure 107, a circuit board 108*b* equipped with an IC (semiconductor memory element) which stores data such as the kind of ink and the residual ink amount in the container is provided. On a surface of this circuit board 108*b*, an electrode (cartridge-side electrode) 108*a* which is electrically connected to the IC and comes into contact with an apparatus-side contact of the recording apparatus body is provided, and the circuit board 108*b* and the electrode 108*a* constitute a memory unit 108. The memory unit 108 is arranged at a position near the ink supply port 103 of the container body 102 as well as the cartridge-side fixing structure 107. Though the memory element and the electrode 108 depicted in FIG. 17*b* are formed on the circuit board 108*b* in the embodiment, this structure is by example only and not limitation and other constructions could be used—for instance, the memory element and the electrode 108*a* can be formed on a flexible printed circuit and arranged at different positions on the container body 102.

More preferably, the memory element can be located near the same corner by which the cartridge-side fixing structure 107 and one of the positioning holes 105*a* are formed. Such an arrangement allows for very precise positioning of all these cartridge structures.

FIG. 18 is an exploded perspective view showing that the ink cartridge 101, and the container body 102 includes a case body 102A of which an upper surface is opened, and a lid member 102B seals the open upper surface of this case body 102A. FIG. 19 shows a state where the lid member 102B is removed from the ink cartridge 101.

As shown in FIGS. 18 and 19, an ink bag 109 having a flexible ink storing part (shown by broken lines for description) that is filled with ink is housed inside the container body 102. The ink bag 109 is affixed to a port part 110 through which the ink stored inside the ink bag 109 can be supplied to the outside. At an inside end part of this port part 110, a check valve 111 is arranged inside and a cap 112 is attached onto the check valve 111. On the other hand, at an outside end part of the port part 110, a spring seat 114 urged by a spring 113 is arranged inside and a seal supply cap 115 is attached.

A film 125 is fixed by heat-welding to a welding border 126, which is formed to surround the periphery of the region of the case body 102A in which the ink bag 109 is housed, thereby to make the inside of the case body 102A into closed space. This closed space is arranged so that the pressurized fluid (pressurized air in this embodiment) introduced from the pressure fluid inlet 104 is contained tightly and does not leak to the outside, and the ink storing part of the ink bag 109 is pressed by the pressurized fluid so that ink can be supplied to the outside. Further, the lid member 102B is fixed to the case body 102A by engagement projections 127 formed in the lid member 102B so as to cover the film 125 thereby to protect the film 125 and prevent useless expansion of the film 125 in the pressurizing time.

FIGS. 20 and 21 show respectively a state where the ink cartridges 101 are mounted to the cartridge mounting parts 201 of the inkjet type recording apparatus 200. For the cartridge mounting part 201, a slider member 202 to which the front surface part of the ink cartridge 101 is connected is provided. This slider member 202 is provided slidably in the inserting and pulling (removing) directions of the ink cartridge 101, and urged by a spring unit in a direction (pulling direction Y) opposite to the inserting direction X of the ink cartridge 101.

FIGS. 22 and 23 show respectively the cartridge mounting part 201 in the state where the cartridge 101 is not mounted to the cartridge mounting part 201. A pair of positioning projections 203*a* and 203*b* are provided by a surface of the slider member 202 opposed to the ink cartridge front surface. For each base part of each positioning projection 203*a*, 203*b*, an apparatus-side positioning surface 204*a*, 204*b* is provided by each shoulder part. The pair of positioning projections 203*a*, 203*b* and the pair of apparatus-side positioning surfaces 204*a*, 204*b* constitute an apparatus-side positioning part.

When the ink cartridge 101 is connected to the slider member 202, the pair of positioning projections 203*a*, 203*b* are inserted into the corresponding pair of positioning holes 105*a*, 105*b* located on the front surface of the ink cartridge 101, and the pair of cartridge-side positioning surfaces 124*a*, 124*b* shown in FIG. 17D come into contact with the pair of apparatus-side positioning surfaces 204*a*, 204*b*.

Turning now to the pair of positioning holes 105*a*, 105*b*, the pair of positioning projections 203*a*, 203*b*, the pair of cartridge-side positioning surfaces 124*a*, 124*b*, and the pair of apparatus-side positioning surfaces 204*a*, 204*b*, it is preferable for one positioning hole 105*a*, one positioning projection 203*a*, one cartridge-side positioning surface 124*a*, and one apparatus-side positioning surface 204*a* to have a function of positioning the ink cartridge 101 in relation to the slider member 202 more precisely. Especially, positioning of the ink cartridge 101 in the inserting direction is precisely performed by the cartridge-side positioning surface 124*a* and the apparatus-side positioning surface 204*a*.

As is clear from FIGS. 15D, 17B and 17D, the positioning holes 105*a* and 105*b* are preferably arranged so that lines passing perpendicularly through those holes themselves lie in a plane P1 that is parallel to the bottom of the ink cartridge, and the bottom groove (more specifically, flat floors of portions 119*b*, 119*c*, 121*c* in this embodiment) of the ink cartridge-side fixing structure.

Also, with reference to FIGS. 15D, 17B-D and 28A-B, it will be recognized that the positioning holes are overlapped by the imaginary extensions (or projections) of the adjoining cartridge-side fixing structure 107 and erroneous mount preventing structure 106. That is, in this embodiment, as shown in FIG. 28B, the positioning hole 105*b* is disposed within a region R1 defined by the erroneous mount preventing structure 106, and the positioning hole 105*a* is disposed within a region R2 defined by the cartridge-side fixing structure 107. Further, in this embodiment, as shown in FIG. 28B, the positioning hole 105*a* is disposed within a region R3 defined by parallel edges 122*a* and 122*b* of an open section defined by edges 122*a*, 122*b*, 122*c* of the front surface of the ink cartridge.

As apparent from FIG. 17B, the positioning hole 105*a* and the cartridge-side positioning surface 124*a* that are used for precise positioning are arranged near the memory unit 108 including the electrode 108*a*. This way, the positioning hole 105*a*, the cartridge-side positioning surface 124*a* and the cartridge-side fixing structure 107 are arranged in the vicinity of the memory unit 108.

Further, the positioning hole 105*a* and the cartridge-side fixing structure 107 are arranged so that the positioning projection 203*a* inserted into the positioning hole 105*a*, and the cartridge-side fixing structure 107 are superimposed on each other in the thickness direction of the container body 102. As a result, the memory unit can be positioned relative to the corresponding contact structure of the printer with improved accuracy.

FIGS. 24A and 24B show respectively a state where the ink cartridge 101 is precisely positioned with respect to the slider member 202 by the positioning hole 105*a*, the positioning projection 203*a*, the cartridge-side positioning surface 124*a* and the apparatus-side positioning surface 203*a*. A fixing pin 212 of the apparatus-side fixing structure 207 is inserted and held in a fixing part 118 of a guide groove 116 of the container body 102.

Further, as shown in FIGS. 22 and 23, a pressure fluid port 205 to be connected to the pressure fluid inlet 104 of the ink cartridge 101 is provided on the surface of the slider member 202 opposed to the front surface of the ink cartridge.

Further, as shown in FIGS. 22 and 23, a contact protrusion part 214 having an apparatus-side contact 213 to be connected to the electrode 108*a* of the memory unit 108 is provided at one end of the front surface of the slider member 202.

FIGS. 25 and 26 show respectively a state where the slider member 202 is removed from the cartridge mounting part 201. An ink supply needle 206 is secured inside the cartridge mounting part 201. The ink cartridge 101 is pushed in together with the slider member 202, whereby the ink supply needle 206 is inserted into the ink supply port 103 of the ink cartridge 101.

It should be understood that the ink supply port 103 is in communication with the interior of the ink cartridge 101. By this it is meant that there is fluid communication between the ink supply port 103 and a region inside the ink cartridge 101, such as the interior of the ink bag 109 contained therein. Such communicating also would cover a structure where the ink bag is omitted and the ink supply port has access directly to the interior of the ink cartridge.

Further, inside the cartridge mounting part 201, the apparatus-side fixing structure 207 is provided, which regulates releasably the movement of the ink cartridge 101 in the pulling direction in cooperation with the cartridge-side fixing structure 107.

The apparatus-side fixing structure 207 has a turn lever member 208. This turn lever member 208 is supported rotatably about its base end part so that it can pivot thereabout, and is urged by a spring member 209 in one rotating direction (counterclockwise for the structure depicted in FIG. 25).

As shown in FIG. 27A-B, the turn lever member 208 comprises an elongate lever body 210, an approximately cylindrical pin attaching part 211 provided at a leading end of this lever body 210, an approximately cylindrical fixing pin 212 which is provided on a top surface of this pin attaching part 211 and which is smaller in diameter than the pin attaching part 211.

As shown in FIGS. 28A-29C, the cartridge-side fixing structure 107 is composed of the guide groove 116 having a rectangular section, into which the fixing pin 212 is inserted. In other words, to define a guide path (i.e., the guide groove 116 in this embodiment) having such a width as to permit the fixing pin 212 to pass therethrough, and therealong, a recess 216 having a perimeter wall 216*a* and a bottom 216*b* is provided to the bottom surface of the ink cartridge, and a guide projection 316 is disposed within the recess 216 so that the guide projection 316 protrudes from the bottom 216*b* of the recess 216 toward the bottom surface of the ink cartridge, as shown in FIG. 30. The guide projection 316 has three edges 316*a*, 316*b* and 316*c*. Accordingly, the guide path (i.e., the guide groove 116 in this embodiment) is defined by the perimeter wall 216*a* and bottom 216*b* of the recess 216 and the edges 316*a*, 316*b* and 316*c* of the guide projection 316. As shown in FIG. 30, the guide projection 316 has a generally-triangular shape with three vertices 316*d*, 316*e* and 316*f*. The vertex 316*f*, preferably each of the vertices 316*e* and 316*f*, is formed as an outward-extending projection as shown in FIG. 30. A portion of the perimeter wall 216*a* of the recess 216 has a projection 216*a*1 extending toward the guide projection 316.

A recess part 117 is formed at a corner on the cartridge rear surface near the positioning hole 105*a* and the cartridge-side positioning surface 124*a* which are used for positioning the cartridge with high accuracy. The guide groove 116 is provided in a recessed manner at the bottom of this recess part 117. The bottom surface of this guide groove 116 is made perpendicular to the side surface of the container body 102 on which the memory unit 108 is arranged.

In mounting and removal operations of the ink cartridge 101 to and from the cartridge mounting part 201, the fixing pin 212 of the turn lever member 208 of the apparatus-side fixing structure 207 is guided by the guide groove 116 of the cartridge-side fixing structure 107.

The guide groove 116 includes the fixing part 118 to which the fixing pin 212 is engaged in the state where the ink cartridge 101 is mounted to the cartridge mounting part 201 and which regulates the movement of the ink cartridge 101 in the pulling direction. The fixing part 118 is mainly defined by the edge 316*b* including a left half of the outward-extending projection 316E as shown in FIG. 30.

Further, the guide groove 116 includes an entrance-side guide part 119 which guides the fixing pin 212 when the ink cartridge 101 is inserted into the cartridge mounting part 201; an intermediate guide part 120 which leads the fixing pin 212 to the fixing part 118 when the ink cartridge 101 that has been inserted into the cartridge mounting part 201 is pushed backward in the pulling direction; and an exit-side guide part 121 which guides, to the exit of the guide groove 116, the fixing pin 212 released from the fixing part 118 by pushing the ink cartridge 101 in the insertion direction when the ink cartridge 101 is removed from the cartridge mounting part 201.

The entrance-side guide part 119 is mainly defined by the edge 316*a*. The intermediate guide part 120 is mainly defined by portions 216*a*2 and 216*a*3 of the perimeter wall 216*a*, the portion 216*a*3 being a left half of the projection 216*a*1 as shown in FIG. 30. The exit-side guide part 121 is mainly defined by a portion 216*a*4 of the perimeter wall 216*a*, the portion 216*a*4 opposing the edge 316*c* of the guide projection 316.

A main portion (linear portion) of the entrance-side guide part 119 of the guide groove 116 is provided to extend at an angle of about 30° to 50° relative to the inserting/pulling direction. Further, an end of the entrance-side guide part 119 is formed to present a curved shape by a projection-shaped wall part 119*d* (316*e*).

Further, an entrance slant surface 122 is formed at an entrance part 116*a* of the guide groove 116. This entrance slant surface 122 slants so that a groove depth becomes shallower in the moving direction of the fixing pin 212 that relatively moves in association with the inserting operation of the ink cartridge 101 into the cartridge mounting part 201.

A width (R3 in FIG. 28B) of the entrance slant surface 122 is set larger than a groove width of the main portion of the guide groove 116 including the fixing part 118 and being formed with the nearly same width. Further, the width of the entrance slant surface 122 is set larger than the diameter of the pin attaching part 211 to which the fixing pin 212 is attached. On the other hand, the groove width of the main portion of the guide groove 116 is set smaller than the diameter of the pin attaching part 211.

Further, a deep groove forming slant surface 119*a* is formed at the entrance-side guide part 119 between the entrance slant surface 122 and the fixing part 118, which slant surface 119*a* slants so that the guide groove 116 becomes deeper in the moving direction of the fixing pin 212 that relatively moves in association with the inserting operation of the ink cartridge 101 into the cartridge mounting part 201. A flat part 119*b* is formed between this deep groove forming slant surface 119*a* and the entrance slant surface 122. Further, a flat part 119*c* is formed, continuing from the deep groove forming slant surface 119*a*.

The depth of the guide groove 116 at the shallowest part formed by the entrance slant surface 122, that is, the groove depth of the flat part 119*b* is smaller than the length of the fixing pin 212. Further, the depth of the guide groove 116 at the deepest part formed by the deep groove forming slant surface 119*a*, that is, the groove depth of the flat part 119*c* is larger than the length of the fixing pin 212.

Further, the intermediate guide part 120 of the guide groove 116 includes a temporarily stopping side wall part 120*a* which stops temporarily the fixing pin 212, moving in the direction of the fixing part 118, in front of the fixing part 118 when the ink cartridge 101 has been inserted into the cartridge mounting part 201 to a sufficient depth. The side wall part 120*a* corresponds to the portion 216*a*3 of the perimeter wall 216*a*.

Further, the fixing part 118 of the guide groove 116 includes a final stopping side wall part 118*a* which receives and stops in a predetermined position the fixing pin 212 that has been released from the temporarily stopping side wall 120*a* and moves to the fixing part 118 when the ink cartridge 101 inserted into the cartridge mounting part 201 to a sufficient depth is pushed back in the pulling direction, thereby stopping the fixing pin 212. The side wall part 118*a* corresponds to the left half of the projection 316*f*.

Further, a curved side wall part 121*a* is formed at a start end of the exit-side guide part 121, a linear slant surface 121*b* is formed continuing from this curved side wall part 121*a*, and further, a linear flat part 121*c* is formed continuing from the slant surface 121*b*.

Accordingly, guide groove 116 includes a flat first floor section corresponding to the flat part 119*b* and leading to a sloped second floor section corresponding to the slant surface 119*a* and leading to a flat third floor section corresponding to the end portion of the entrance-side guide part 119, the intermediate guide part 120, the fixing part 118 and the beginning portion of the exit-side guide part 121 and leading to a sloped fourth floor section corresponding to the slant surface 121*b* and leading to a flat fifth floor section corresponding to the flat part 121*c*. As shown in FIG. 15A, the first and second floor sections are disposed along a first line L1, a portion of the third floor section corresponding to the parts 120 and 118 and the beginning portion of the part 121 is approximately disposed along a second line L2, and the fourth and fifth floor sections are disposed along a third line L3. The second and third lines L2, L3 intersect at a right angle. In addition, the bottom of the guide groove 116, corresponding to the first, third and fifth floor sections, is in parallel to the bottom surface of the ink cartridge.

Further, an exit part 116*b* of the guide groove 116 is connected to the entrance part 116*a*, whereby the guide groove 116 forms a loop as a whole. In the connection part between the entrance part 116*a* and the exit part 116*b*, the groove depth of the exit part 116*b* is shallower than the groove depth of the entrance part 116*a*, whereby a step part 123 (shown in FIG. 29B) is formed at the connection part. This step part 123 prevents the fixing pin 212 from entering the flat part 121*c* when the ink cartridge 101 is inserted into the cartridge mounting part 201.

Next, the operation of the fixing pin 212 into the guide groove 116 in the mounting and removal operation of the ink cartridge 101 will be described with reference to FIG. 30. It should be understood that arrow Z in FIG. 30 represents an urging direction of the turn lever member 208 resulting from the biasing action of the spring member 209.

After the ink cartridge 101 has inserted into the cartridge mounting part 201 and connected to the slider member 202, when the ink cartridge 101 is further pushed in the insertion direction X against the urging force of the slider member 202, the fixing pin 212 of the turn lever member 208 is inserting into the entrance part 116*a* of the guide groove 116 (position A in FIG. 30) through the open section 122*a*, 122*b*, 122*c* of the front surface of the ink cartridge.

Since the entrance slant surface 122 is formed at the entrance part 116*a* of the guide groove 116, the fixing pin 212, sliding on this entrance slant surface 122, moves in the opposite direction to the groove depth direction. Hereby, the turn lever member 208 or a member supporting the turn lever member 208 deforms elastically, so that force urging the fixing pin 212 toward the bottom surface of the guide groove 116 is produced.

When the leading end of the fixing pin 212 firstly comes into contact with the entrance slant surface 122, the top surface of the pin attaching part 211 is located in the lower position than the edge level of the guide groove 116. While the fixing pin 212 moves on the entrance slant surface 122, the groove depth changes so that the top surface of the pin attaching part 211 exceeds the edge level of the guide groove 116.

When the fixing pin 212 passes through the entrance slant surface 122 and next gets over the flat part 119*b* (position B in FIG. 30), only the fixing pin 212 is inserted into the guide groove 116, and the pin attaching part 211 is located outside the guide groove 116. This is because the depth of the guide groove 116 at the flat part 119*b* is set smaller than the length of the fixing pin 212.

By thus providing the entrance slant surface 122 for the entrance part 116*a* of the guide groove 116, it is possible to prevent, when the fixing pin 212 is inserted into the entrance part 116*a* of the guide groove 116, the fixing pin 212 from being caught by the front surface of the ink cartridge 101, so that the insertion of the fixing pin 212 into the entrance part 116*a* of the guide groove 116 can be performed smoothly and surely.

Further, since the entrance slant surface 122 is formed and the groove depth of the flat part 119*b* continuing from this surface 122 is set smaller than the length of the fixing pin 212, even in case that the width of the entrance part 116*a* of the guide groove 116 is set large and the width of the groove continuing from this part 116*a* is made narrow like that in the embodiment, the pin attaching part 211 is not caught in the narrow-width part of the guide groove 116. By setting the width of the entrance part 116*a* of the guide groove 116 large, the fixing pin 212 can be inserted into the guide groove 116 surely.

When the ink cartridge 101 is further pushed in the inserting direction X, the fixing pin 212 passes through the flat part 119*b*, and moves in the groove depth direction (position C in FIG. 30), sliding on the deep groove forming slant surface 119*a*.

When the fixing pin 212 passes through the deep groove forming slant surface 119*a* and comes to the position of the flat part 119*c* (position D in FIG. 30), the peripheral edge part of the top surface of the pin attaching part 211 fits to the edge part of the guide groove 116 and is pressed against this edge part. This is because of the continuing elastic deformation produced in the turn lever member 208 when the fixing pin 212 passes through the entrance slant surface 122 and which is still present at this time. By thus fitting the peripheral edge part of the top surface of the pin attaching part 211 to the edge part of the guide groove 116, it is possible to prevent the turn lever member 208 from coming into contact with the surface including the edge part of the guide groove 116 (bottom surface of the recess part 117), thereby preventing the fixing pin 212 from rising out of the guide groove 116.

Further, when the fixing pin 212 comes to the position of the flat part 119*c* (position D in FIG. 30), the leading end of the fixing pin 212 is separated from the bottom surface of the guide groove 116. This is because the groove depth of the flat part 119*c* is set larger than the length of the fixing pin 212.

When the ink cartridge 101 is further pushed in the inserting direction X, and the fixing pin 212 exceeds the position (position E in FIG. 30) near the leading end of the projection-like wall part 119*d* located at the end of the entrance-side guide part 119, the fixing pin 212 moves in the direction Z by the urging force of the spring member 209. Then, the fixing pin 212 strikes the temporarily stopping side wall 120*a* and stops (position F in FIG. 30). At this time, an audible click is produced. Upon hearing this click, the user is able to confirm that the ink cartridge 101 has been inserted to sufficient depth.

When the user stops pressing the ink cartridge 101 in the inserting direction X, the ink cartridge 101 is pushed back slightly in the pulling direction Y (that is, toward the user) by the urging force of the slider member 202. Hereby, engagement of the fixing pin 212 to the temporarily stopping side wall 120*a* is released, and the fixing pin 212 moves in the direction Z in response to the urging force of the spring member 209. Then, the fixing pin 212 collides with the lastly stopping side wall 118*a* and stops in the fixing position (position G in FIG. 30), and an audible click is produced at this time. By hearing this click, the user can confirm that the ink cartridge 101 has been properly fixed to the cartridge mounting part 201.

Here, the depth of the groove in the fixing part 118 of the guide groove 116 is set larger than the length of the fixing pin 212 similarly to that in the flat part 119*c* of the entrance-side guide part 119. Further, by the elastic deformation of the turn lever member 208 produced when the fixing pin 212 passes through the entrance slant surface 122, the fixing pin 212 is urged toward the bottom surface of the guide groove 116.

Therefore, regarding the fixing pin 212 fixed in the predetermined fixing position of the stopping part 118, its full length enters into the inside of the guide groove 116, and the peripheral edge part of the top surface of the pin attaching part 211 fits against the edge part of the guide groove 116. Hereby, this fitting against the side wall of the guide groove 116 can serve to prevent the fixing pin 212 (particularly, its base part) from experiencing creep resulting from the force applied to the fixing pin 212. Namely, in case that the fixing pin 212 is caught in the guide groove 116 shallowly, the force applied to the base part of the fixing pin 212 increases by the principle of levers. However, in the embodiment, since the fixing pin 212 is caught in the guide groove 116 throughout its full length as described above, the creep of the fixing pin 212 can be prevented.

Further, since the fixing pin 212 is caught in the guide groove 116 deeply enough, the fixing pin 212 never comes out of the guide groove 116. This effect is not limited to only the fixing part 118 but is obtained also while the fixing pin 212 is relatively moving in the guide groove 116 in case that the peripheral edge part of the top surface of the pin attaching part 211 slides along the edge part of the guide groove 116.

Further, the fixing pin 212 is urged toward one side surface of the ink cartridge 101 by the spring member 209, and the electrode 108*a* of the memory unit 108 is provided on this side surface. Therefore, the urging force of the spring member 209 acts through the fixing pin 212 and the lastly stopping side wall part 118*a* so that the electrode 108 of the memory unit 108 is pressed toward the apparatus-side contact 213 (FIGS. 22 and 23). Hereby, it is possible to secure the connections between the electrode 108*a* of the memory unit 108 and the apparatus-side contact 213.

Next, when the ink cartridge 101 is removed from the cartridge mounting part 201, the ink cartridge 101 is pushed slightly in the inserting direction X by the user. Then, engagement of the fixing pin 212 with the lastly stopping side wall 118*a* is released, and the fixing pin 212 moves in the direction Z in response to the urging force exerted by the spring member 209. Next, the fixing pin 212 collides with the curved side wall 121*a* of the exit-side guide part 121 of the guide groove 116 and temporarily stops (position H in FIG. 30). At this time, an audible click is produced. By hearing the click, the user can confirm that fixing of the ink cartridge 101 to the cartridge mounting part 201 has been released.

Next, the user stops pressing the ink cartridge 101 in the inserting direction X. When the ink cartridge 101 moves in the pulling direction Y in response to the urging force of the slider member 202, the fixing pin 212 moves along the linear slant surface 121*b* of the exit-side guide part 121 (position I in FIG. 30). At this time, the leading end of the fixing pin 212 comes into contact with the slant surface 121*b* in the middle of the slant surface 121*b*, and the fixing pin 212 moves upward in the opposite direction to the groove depth direction. The fixing pin 212 that has passed through the slant surface 121*b* passes through the flat part 121*c* (position J in FIG. 30) and out from the exit part 116*b* of the guide groove 116.

Next, a connection process of the ink cartridge 101 to the ink supply needle 206, etc. when the ink cartridge 101 is mounted to the cartridge mounting part 201 will be described.

When the ink cartridge 101 is inserted into the cartridge mounting part 201, firstly, the positioning projections 203*a*, 203*b* of the slider member 202 are inserted into the positioning holes 105*a*, 105*b* of the ink cartridge 101. Further, the pressure fluid port 205 of the slider member 202 is connected to the pressure fluid inlet 104 of the ink cartridge 101. Further, the electrode 108*a* of the memory unit 108 and the apparatus-side contact 213 are connected to each other, whereby electrical communication can be established.

The electrode 108*a* of the memory unit 108 and the apparatus-side contact 213 establish electrical communication before the ink supply needle 206 has been inserted into the ink supply port 103 of the ink cartridge. Accordingly, the data is read from the memory unit 108 at this time, and a determination is made whether the proper ink cartridge 101 has been inserted. If the wrong ink cartridge 101 has been inserted, then before the ink supply needle 206 is inserted into the ink supply port 103 of the wrong ink cartridge 101, there is an opportunity to replace the wrong ink cartridge with the proper ink cartridge. Hereby, it is possible to prevent the wrong type of ink from flowing into the ink flowing path of the apparatus body. Further, in this situation, when the ink supply port 103 of the ink cartridge 101 that has been inserted wrongly is sealed by a seal, it is possible to avoid breaking the seal unnecessarily.

After the ink cartridge 101 has been connected to the slider member 202, the ink cartridge 101 is further pushed in the inserting direction X against the urging force of the slider member 202, whereby the ink supply needle 206 is inserted into the ink supply port 103 of the ink cartridge 101.

Next, a separation process for disengaging the ink cartridge 101 from the ink supply needle 206 when the ink cartridge 101 is detached from the cartridge mounting part 201 will be described.

As described above, by pushing the ink cartridge 101 inward in the inserting direction X, fixing of the ink cartridge 101 by the cartridge-side fixing structure 107 and the apparatus-side fixing structure 207 is released, and the ink cartridge 101 can move in the pulling direction Y. The ink cartridge, released and no long fixed in position, moves firstly in the pulling direction Y together with the slider member 202, and the ink supply needle 206 comes out from the ink supply port 103 as a result of this movement.

When the ink supply needle 206 thus comes out from the ink supply port 103, since the connection between the electrode 108*a* of the memory unit 108 and the apparatus-side contact 213 is still maintained, data can be exchanged between the memory unit 108 and the apparatus body. Even though the ink cartridge has been released, data can be exchanged between the memory unit 108 of the cartridge 101 and the apparatus body, so that data transmission errors can be prevented.

When the ink cartridge is further moved in the pulling direction Y, the slider member 202 reaches a position in the predetermined position at which it becomes unmovable. When the ink cartridge 101 is further moved in the pulling direction Y from this state, the pressure fluid port 205 is separated from the pressure fluid inlet 104 of the ink cartridge 101, and the positioning projections 203*a*, 203*b* come out of the positioning holes 105*a*, 105*b* of the ink cartridge 101. Further, the electrode 108 of the memory unit 108 and the apparatus-side contact 213 are disconnected.

As described above, the ink cartridge 101 according to the embodiment can be mounted to the cartridge mounting part 201 of the ink jet type recording apparatus 200 readily and surely.

Particularly, in the ink cartridge 101 according to the embodiment, since the width of the entrance slant surface 122 formed at the entrance part 116*a* of the guide groove 116 can be made large, the insertion of the fixing pin 212 into the guide groove 116 can be surely performed. Since the turn lever member 208 including the fixing pin 212 is constructed so as to swing in the direction Z perpendicular to the inserting and pulling directions X, Y of the ink cartridge 101, variations may be produced in the initial position (the position in a state where the ink cartridge has not been mounted yet) of the fixing pin 212. However, by making the width of the entrance slant surface 122 large, these variations can be accommodated.

Further, in the ink cartridge 101 according to the embodiment, it is possible to complete the mounting operation by only one operation (single push operation) that the ink cartridge 101 is inserted into the cartridge mounting part 201. On the other hand, when the ink cartridge 101 is removed from the cartridge mounting part 201, the fixing state of the ink cartridge 101 can be released by only the easy operation that the ink cartridge 101 is slightly pushed in. In the embodiment, it is possible to perform the mounting and removal operations of the ink cartridge 101 very readily like this.

Further, in the ink cartridge 101 according to this embodiment, since the guide groove 116 is formed on the bottom surface of the recess part 117 formed on the surface of the cartridge, in the state where the fixing pin 212 is inserted into the guide groove 116, the protruding amount of the turn lever member 208 from the cartridge surface can be reduced or even made zero. Therefore, the thickness of the cartridge mounting part 201 can be reduced, so that the size the ink jet type recording apparatus 200 can be decreased. Particularly, in the case of an apparatus of the type in which the plural ink cartridges 101 are arranged in a flat and juxtaposed manner such as the ink jet type recording apparatus 200 shown in FIG. 14, it is desirable to reduce the thickness of the whole of the apparatus. Therefore, the ink cartridge 101 according to the embodiment, which can reduce the thickness of the cartridge mounting part 201, is very effective and helpful to achieving this goal.

Further, in the ink cartridge 101 according to the embodiment, since the memory unit 108 including the electrode 108*a* is arranged near the cartridge-side fixing structure 107, the electrode 108*a* of the memory unit 108 can be surely and securely connected to the apparatus-side contact 213 of the cartridge mounting part 201.

Particularly, since the urging force of the spring member 209 acts so as to press the electrode 108*a* of the memory unit 108 in the direction of the apparatus-side contact 213 of the cartridge mounting part 201 through the fixing pin 212 and the lastly stopping side wall 118*a*, the electrode 108 of the memory unit 108 can be surely connected to the apparatus-side contact 213.

Further, since the cartridge-side fixing structure 107 and the memory unit 108 including the electrode 108*a* are arranged at a position near the ink supply port 103 of the whole of the container body 102, the connection of the electrode 108 of the memory unit 108 to the apparatus-side contact 213 can be more surely performed.

Further, the memory unit 108, including the electrode 108*a*, is arranged near the cartridge-side fixing structure 107, and the positioning hole 105*a* and the cartridge-side positioning surface 124*a* that are used for accurate positioning. Therefore, the connection of the electrode 108 of the memory unit 108 to the apparatus-side contact 213 can be more surely performed.

What is claimed is:

1. A liquid container, comprising:

a container body having a first wall and a second wall, the first wall lying in a first plane and the second wall lying in a second plane that intersects the first plane, the container body having an interior;

a liquid supply port formed in the second wall;

a recess formed in the first wall, the recess including a floor lying in a plane parallel to the first plane and a perimeter wall;

a guide structure disposed within the recess, at least a portion of said guide structure extending from the floor of the recess toward the first wall; and a first slanted surface that is inclined from a first part of the floor of the recess toward the first wall, the first slanted surface being located between the guide structure and the perimeter wall, wherein the perimeter wall has two straight side portions and a generally M-shaped portion having side legs, the side legs of the M-shaped portion meeting, respectively, the straight side portions.

2. The liquid container of claim 1, wherein the side legs of the M-shaped portion are not parallel to the straight side portions.

3. A liquid container, composing:

a container body having a first wall and a second wall, the first wall lying in a first plane and the second wall lying in a second plane that intersects the first plane, the container body having an interior;

a liquid supply port formed in the second wall;

a recess formed in the first wall, the recess including a floor lying in a plane parallel to the first plane and a perimeter wall;

a guide structure disposed within the recess, at least a portion of said guide structure extending from the floor of the recess toward the first wall;

a first slanted surface that is inclined from a first part of the floor of the recess toward the first wall, the first slanted surface being located between the guide structure and the perimeter wall; and a supplemental guide structure disposed within the recess, the supplemental guide structure having a third slanted surface that is inclined from a third part of the floor of the recess toward the first wall, wherein the supplemental guide structure is located opposite from the second wall with respect to the guide structure, as viewed in a direction perpendicular to the first plane, wherein the recess, the guide structure and the supplemental guide structure are dimensioned so that a path of at least a minimum width exists between the guide structure and the perimeter wall, and wherein the path is generally M-shaped.

4. The liquid container of claim 3, wherein the side legs of the M-shaped path are at least in part parallel.

5. A liquid container, comprising:

a container body having a first wall and a second wall, the first wall lying in a first plane and the second wall lying in a second plane that intersects the first plane, the container body having an interior;

a liquid supply port formed in the second wall;

a recess formed in the first wall, the recess including a floor lying in a plane parallel to the first plane and a perimeter wall; and a guide structure disposed within and occupying a portion of the recess, at least a portion of the guide structure extending from the floor of the recess toward the first wall, the guide structure having a first side wall, a second side wall leading from the first side wall and a third side wall leading from the second side wall, the guide structure being sized so that there is a path of at least a minimum width between the perimeter wall and the first side wall, the second side wall and the third side wall, wherein the path is generally M-shaped.

6. The liquid container of claim 5, wherein the side legs of the M-shaped path are at least in part parallel.

* * * * *